US007887153B2

(12) United States Patent
Takata

(10) Patent No.: US 7,887,153 B2
(45) Date of Patent: Feb. 15, 2011

(54) LIQUID DISCHARGING APPARATUS

(75) Inventor: Masayuki Takata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 310 days.

(21) Appl. No.: 12/243,835

(22) Filed: Oct. 1, 2008

(65) Prior Publication Data

US 2009/0085950 A1 Apr. 2, 2009

(30) Foreign Application Priority Data

Oct. 1, 2007 (JP) ..... 2007-257993

(51) Int. Cl.
*B41J 29/377* (2006.01)

(52) U.S. Cl. ..... 347/18

(58) Field of Classification Search ..... 347/18
See application file for complete search history.

(56) References Cited

U.S. PATENT DOCUMENTS 5,017,941 A * 5/1991 Drake ..... 347/67
6,336,696 B1 * 1/2002 Ellson et al. ..... 347/18
6,484,975 B1 * 11/2002 Elrod et al. ..... 347/18
6,607,259 B2 * 8/2003 Mott et al. ..... 347/18
6,796,630 B2 * 9/2004 Ison et al. ..... 347/18
7,149,090 B2 12/2006 Suzuki et al.
2006/0250451 A1 11/2006 Suzuki et al.

FOREIGN PATENT DOCUMENTS

JP H09-254391 A 9/1997
JP H10-291300 A 11/1998
JP 2003-080793 A 3/2003

* cited by examiner

*Primary Examiner*—Julian D Huffman
(74) *Attorney, Agent, or Firm*—Baker Botts L.L.P.

(57) ABSTRACT

A liquid discharging apparatus includes: a liquid discharging head that is provided on a carriage being moved with respect to a recording medium, a recording liquid, which is supplied from a recording liquid supply source, being supplied to the liquid discharging head through a recording liquid flow channel on the carriage; a heat emitting element that emits heat with an discharging operation of the liquid discharging head; a cooling liquid flow channel that is provided on the carriage and passes around the heat emitting element; and a heat sink that is provided between the heat emitting element and the cooling liquid flow channel, at least a part of the heat sink being exposed to the cooling liquid flow channel so as to serve as a part of an inner surface of a wall partitioning the cooling liquid flow channel.

12 Claims, 17 Drawing Sheets

LIQUID DISCHARGING APPARATUS

CROSS REFERENCE TO RELATED APPLICATION

The present application claims priority from Japanese Patent Application No. 2007-257993, which was filed on Oct. 1, 2007, the disclosure of which is herein incorporated by reference in its entirety.

TECHNICAL FIELD

Apparatus consistent with the present invention relate to a liquid discharging apparatus, such as an ink jet printer or the like.

BACKGROUND

There is known an ink jet printer that discharges ink from nozzles of an ink jet head provided on a reciprocating carriage, thereby recording an image on a sheet or the like.

The ink jet head includes a flow channel unit that is formed by laminating a plurality of plates, and a piezoelectric actuator that gives an ejection output to a liquid chamber in the flow channel unit. A flexible flat wire member is laminated on the actuator to be connected to individual electrodes. On the flexible flat wire member, a driving circuit for driving the actuator is provided in forms of an IC chip, and the IC chip is in direct contact with a heat sink (for example, see Patent Document 1).

[Patent Document 1] JP-A-2003-80793

[Patent Document 2] JP-A-10-291300

SUMMARY

In recent years, in the ink jet printer, demands for high-speed printing tend to result in an increase in processing speed of the driving circuit, or demands for high resolution and reduction in size tend to result in an increase in the number of nozzles and high density of the nozzles. For this reason, a large load is applied to the IC chip or the actuator, and accordingly the amount of heat emission is increased. If the apparatus is reduced in size, the area of the heat sink is inevitably reduced, and accordingly a heat dissipation effect is deteriorated. If heat from the IC chip or the actuator is transmitted to ink and ink is raised to high temperature. The increase in ink temperature leads to a decrease in ink viscosity an increase in ejection speed. As a result, displacement in land position on the sheet or a variation in diameter of the landed pixel occurs, and ejection accuracy becomes unstable.

As a countermeasure against such a problem, a technology is suggested in which a cooling liquid is circulated to keep the ink jet head within an appropriate temperature range (for example, see Patent Document 2). However, there is no disclosed a specific configuration for head dissipation of the IC chip or the actuator. As a result, there is a need for a structure that is capable of efficiently radiating heat even though the apparatus is reduced in size.

It is an object of the invention to provide a structure suitable for improving heat dissipation efficiency.

According to an exemplary embodiment of the present invention, a liquid discharging apparatus includes: a liquid discharging head that is provided on a carriage being moved with respect to a recording medium, a recording liquid, which is supplied from a recording liquid supply source, being supplied to the liquid discharging head through a recording liquid flow channel on the carriage; a heat emitting element that emits heat with an discharging operation of the liquid discharging head; a cooling liquid flow channel that is provided on the carriage and passes around the heat emitting element; and a heat sink that is provided between the heat emitting element and the cooling liquid flow channel, at least a part of the heat sink being exposed to the cooling liquid flow channel so as to serve as a part of an inner surface of a wall partitioning the cooling liquid flow channel.

BRIEF DESCRIPTION OF THE DRAWINGS

Illustrative aspects of the invention will be described in detail with reference to the following figures wherein.

DETAILED DESCRIPTION OF THE PREFERRED EMBODIMENTS

An exemplary embodiment of the present invention will now be described with reference to the drawings. In the following description, a direction in which ink is discharged from an ink jet head is referred to as downward, and an opposite side thereof is referred to as upward.

Figure 1:
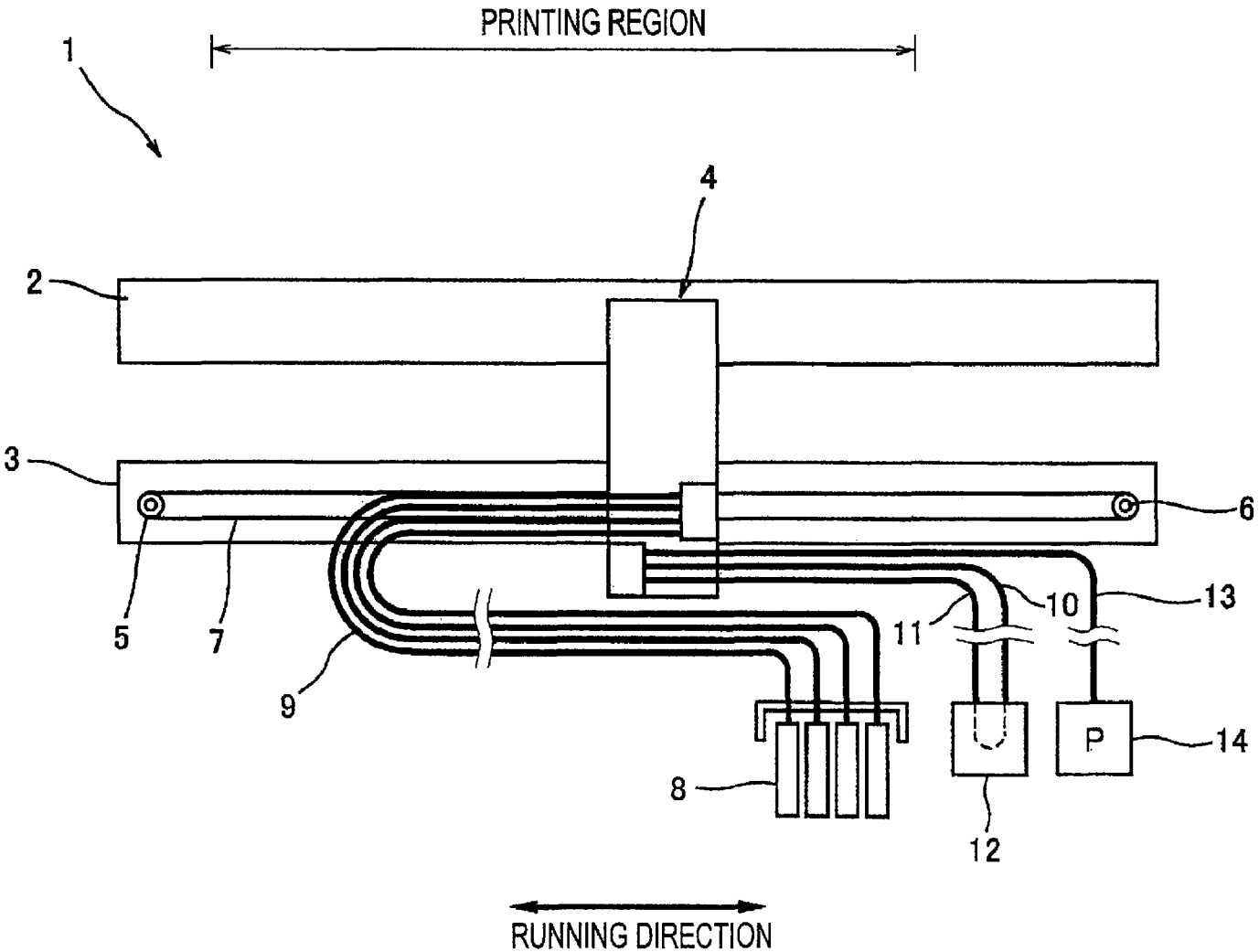
FIG. 1 is a schematic perspective view showing parts of an ink jet printer according to an exemplary embodiment of the invention.

FIG. 1 is a schematic perspective view showing parts of an ink jet printer 1 according to an exemplary embodiment of the present invention. As shown in FIG. 1, the inkjet printer 1 (liquid discharging apparatus) is provided with a pair of guide rails 2 and 3 substantially arranged in parallel, and a head unit 4 is supported by the guide rails 2 and 3 so as to be slidable in a running direction. The head unit 4 is bonded with a timing belt 7 that is wound around a pair of pulleys 5 and 6, and the timing belt 7 is substantially arranged in parallel with an extension direction of the guide rail 3. A motor (not shown) which normally and reversely rotates is provided in one pulley 6. Normal and reverse rotation of the pulley 6 causes the timing belt 7 to reciprocate, and the head unit 4 is reciprocally moved in one direction along the guide rails 2 and 3.

Four flexible ink supply tubes 9 (recording liquid supply tube) to supply ink of four colors (black, cyan, magenta, and yellow) from four ink cartridges 8 (recording liquid supply source) are connected to the head unit 4. An ink jet head 33 (described below with reference to FIG. 4) is mounted on the head unit 4, and ink (recording liquid) is discharged from the inkjet head 33 toward a recording medium (for example, recording sheet) which is conveyed in a direction (sheet feed direction) perpendicular to the running direction below the ink jet head 33.

A flexible outgoing tube 10 and a flexible returning tube 11 are connected to the head unit 4. The outgoing tube 10 forms a cooling liquid outgoing channel, and the returning tube 11 forms a cooling liquid returning channel. The outgoing tube 10 and the returning tube 11 are connected so as to circulate with each other by a radiator tank 12. An end of a flexible negative pressure suction tube 13 is connected to the head unit 4. The negative pressure suction tube 13 extracts air trapped in a flow channel of the head unit 4. The other end of the negative pressure suction tube 13 is connected to a negative pressure pump 14.

Figure 2:
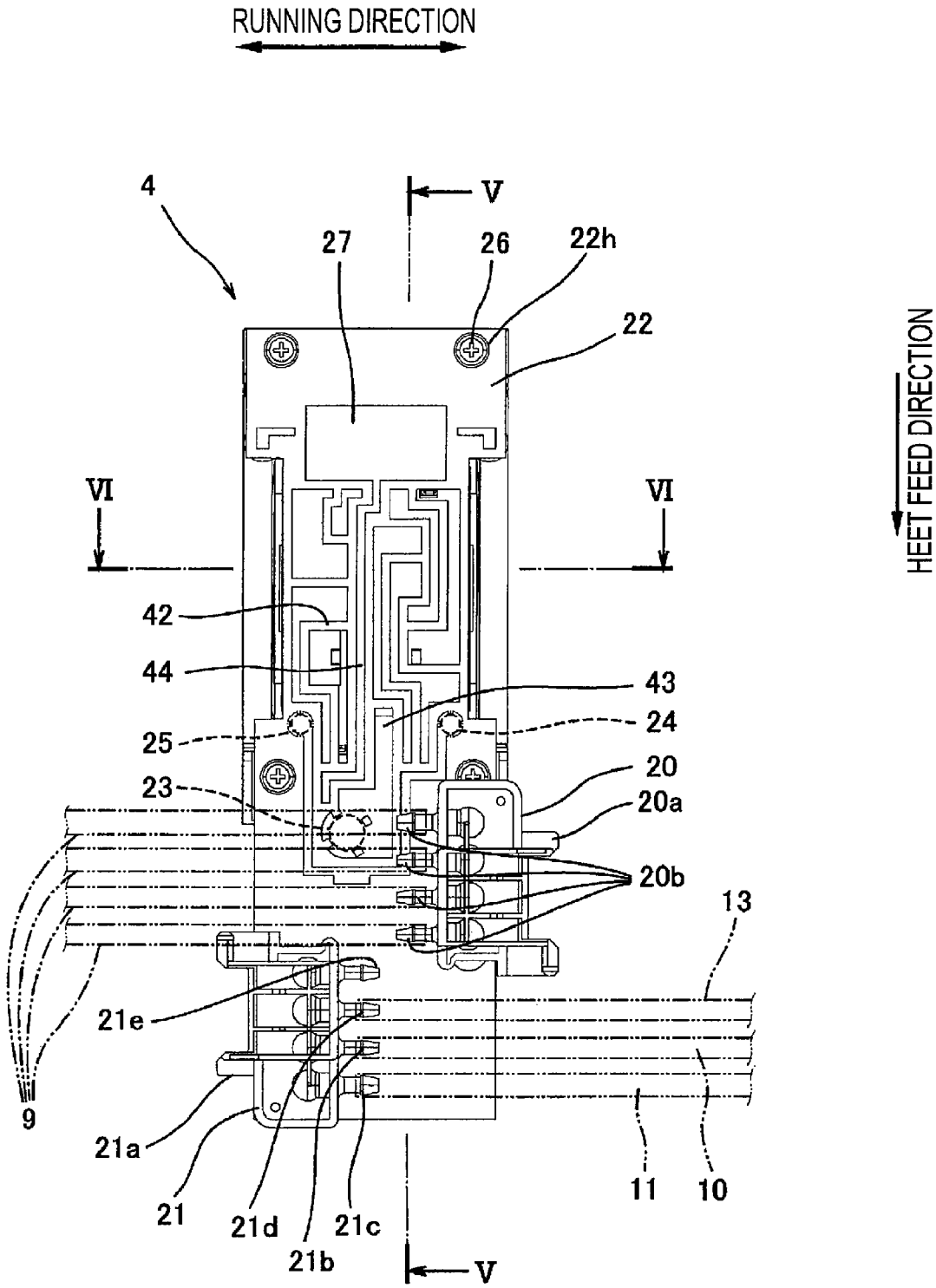
FIG. 2 is a plan view of ahead unit in the ink jet printer shown in FIG. 1.
Figure 3:
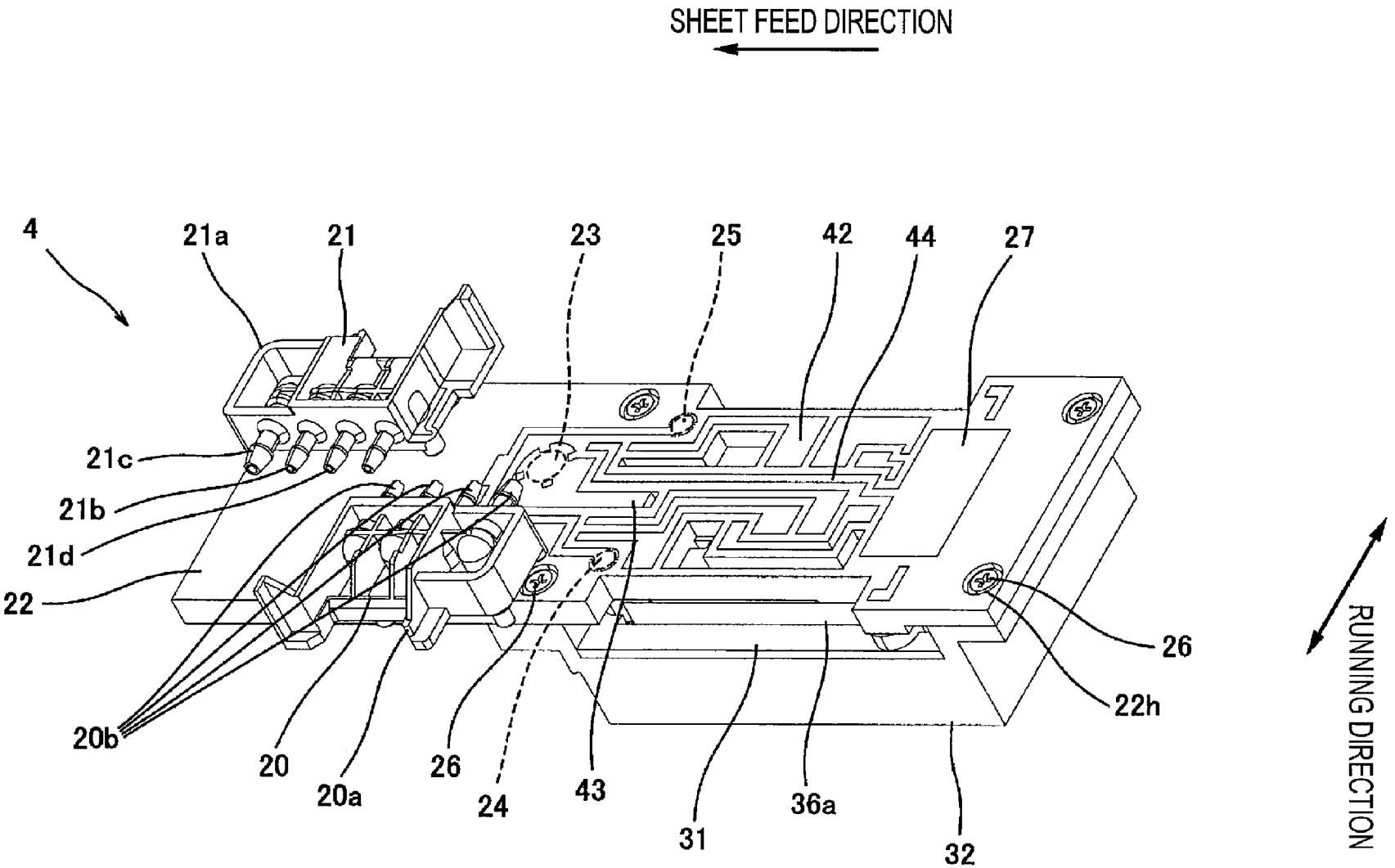
FIG. 3 is a perspective view of the head unit in the ink jet printer shown in FIG. 1.
Figure 4:
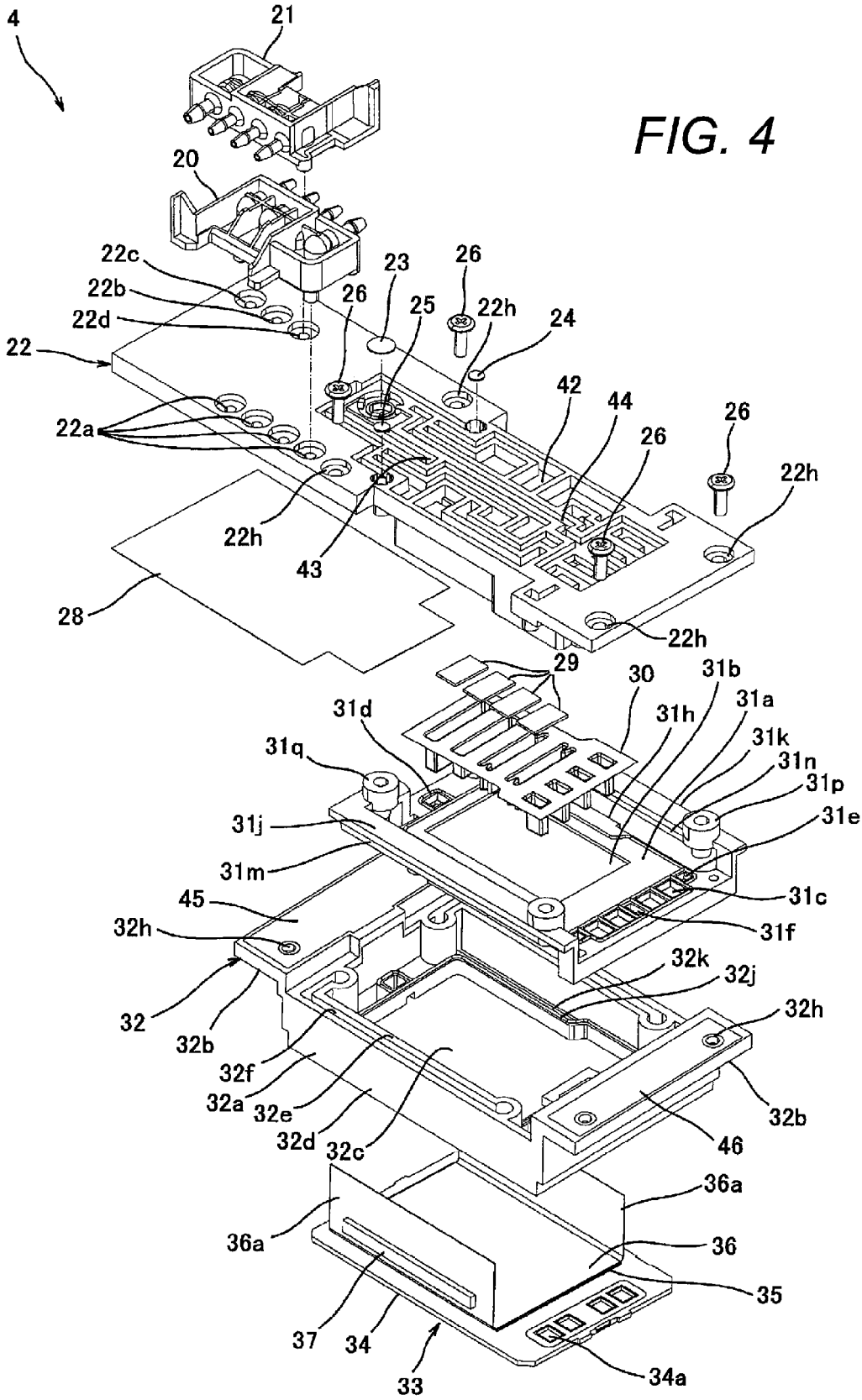
FIG. 4 is an exploded perspective view of the head unit in the ink jet printer shown in FIG. 1.

FIG. 2 is a plan view of the head unit 4 in the ink jet printer 1 shown in FIG. 1. FIG. 3 is a perspective view of the head unit 4 in the ink jet printer 1 shown in FIG. 1. FIG. 4 is an exploded perspective view of the head unit 4 in the ink jet printer 1 shown in FIG. 1. In FIG. 4, a film which is welded to an upper surface of a flow channel forming member 22 is not shown. As shown in FIGS. 2 to 4, the head unit 4 includes joints 20 and 21, the flow channel forming member 22, check valves 23 to 25, screws 26, air-liquid separation films 27 and 29, a flat film 28, a damper film 30, an elastic seal member 31, a carriage 32, and the ink jet head 33.

The joint 20 for ink has a base portion 20*a* that is attached to the upper surface of the flow channel forming member 22, and four ink joint tube portions 20*b* (recording liquid joint tube) that are led from the base portion 20*a* toward one side (a left side in FIG. 2) in the running direction of the carriage 32. The ink supply tubes 9 are correspondingly connected to the ink joint tube portions 20*b*. The joint 20 is made of hard resin (for example, polypropylene), and the ink supply tubes 9 are made of soft resin (for example, nylon). The joint 20 has hardness larger than those of the ink supply tubes 9. Therefore, the environs of connection portions of the ink supply tubes 9 to the ink joint tube portions 20*b* are kept to be led to one side (the left side in FIG. 2) in the running direction of the carriage 32.

The joint 21 for cooling liquid and negative pressure suction has a base portion 21*a* that is attached to the upper surface of the flow channel forming member 22, and four joint tube portions 21*b*, 21*c*, 21*d*, and 21*e* that are led from the base portion 21*a* toward the other side (a right side in FIG. 2) in the running direction of the carriage 32. Two from among the four joint tube portions 21*b*, 21*c*, 21*d*, and 21*e* are cooling liquid joint tube portions 21*b* and 21*c* for cooling liquid, one is a negative pressure joint tube portion 21*d* for negative pressure suction, and the other one is an unusable joint tube portion 21*e* (in terms of common utilization of parts, the joint 21 is the same as the joint 20 in structure, and thus an unusable joint tube portion 21*e* is provided).

The outgoing tube 10 is connected to the cooling liquid joint tube portion 21*b*, the returning tube 11 is connected to the cooling liquid joint tube portion 21*c*, and the negative pressure suction tube 13 is connected to the negative pressure joint tube portion 21*d*. The joint 21 is made of hard resin (for example, polypropylene), and the outgoing tube 10, the returning tube 11, and the negative pressure suction tube 13 are made of soft resin (for example, nylon). The joint 21 has hardness larger than the outgoing tube 10, the returning tube 11, and the negative pressure suction tube 13. Therefore, the environs of connection portions of the outgoing tube 10, the returning tube 11, and the negative pressure suction tube 13 to the cooling liquid joint tube portions 21*b*, 21*c*, and 21*d* are kept to be led to the other side (the right side in FIG. 2) in the running direction of the carriage 32.

The flow channel forming member 22 substantially has a flat plate shape, and is provided with a plurality of grooves in the upper and lower surfaces. A plurality of flow channels are provided by thermally welding a film to the upper and lower surfaces so as to seal the grooves. Specifically, the flow channel forming member 22 is provided with four ink inlet port 22*a* in the upper surface on a downstream side in the sheet feed direction and the other side in the running direction. The flow channel forming member 22 is also provided with a cooling liquid inlet port 22*b*, a cooling liquid outlet port 22*c*, and a negative pressure suction port 22*d* in the upper surface on the downstream side of the sheet feed direction and the one side of the running direction. The flow channel forming member 22 is also provided with a carriage-side ink flow channel 42 that communicates with the ink inlet ports 22*a*, a cooling liquid flow channel 43 that communicates with the cooling liquid inlet port 22*b* and the cooling liquid outlet port 22*c*, and an air exhaust flow channel 44 that communicates with the negative pressure suction port 22*d*.

Three check valves 23 to 25 are arranged in the cooling liquid flow channel 43. The check valves 23 to 25 permits the flow of the cooling liquid from the cooling liquid inlet port 22*b* toward the cooling liquid outlet port 22*c*, and checks the flow of the cooling liquid from the cooling liquid outlet port 22*c* toward the cooling liquid inlet port 22*b*. Specifically, at a place where the flow of the cooling liquid from the cooling liquid inlet port 22*b* toward the cooling liquid outlet port 22*c* is directed from the lower surface of the flow channel forming member 22 toward the upper surface, a lower-side small diameter flow channel and a large diameter flow channel connected to an upper side of the small diameter flow channel are provided in the cooling liquid flow channel 43. And, waterproof films are arranged in the large diameter flow channel as the check valves 23 to 25. The check valves 23 to 25 have a diameter larger than that of the small diameter flow channel and smaller than that of the large diameter flow channel, and has a specific gravity larger than that of the cooling liquid to be then freely floated. Therefore, if the cooling liquid goes from the cooling liquid inlet port 22*b* toward the cooling liquid outlet port 22*c*, the check valves 23 to 25 are floated and communicate with the small diameter flow channel and the large diameter flow channel. If the cooling liquid goes from the cooling liquid outlet port 22*c* toward the cooling liquid inlet port 22*b*, the check valves 23 to 25 are sunken and close the small diameter flow channel. Through holes 22*h* into which the screws 26 are inserted are provided at required places of the flow channel forming member 22.

Figure 5:
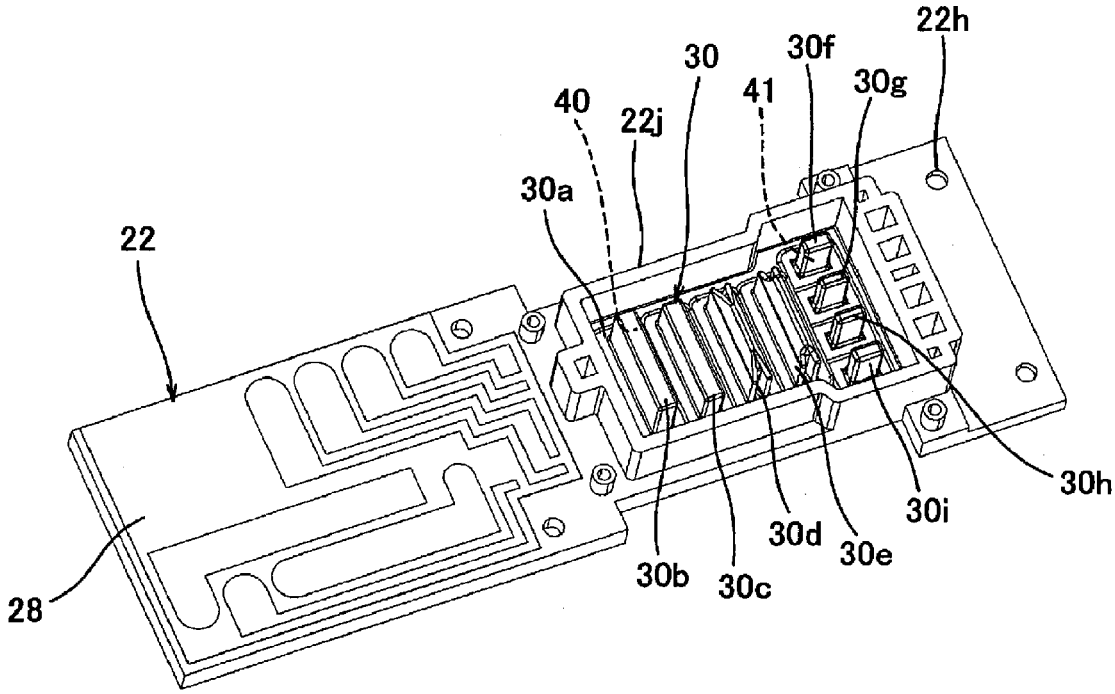
FIG. 5 is a perspective view of a flow channel forming member and a damper film in the head unit shown in FIG. 4 when viewed from the below.

FIG. 5 is a perspective view when the flow channel forming member 22 and the damper film 30 in the head unit 4 shown in FIG. 4 are viewed from the below. As shown in FIG. 5, various flow channels are formed by sealing the grooves in the lower surface of the flow channel forming member 22 with the flat film 28. A peripheral rib 22*j* is formed in the lower surface of the flow channel forming member 22 to protrude downward. The damper film 30 is thermally welded inside the peripheral rib 22*j*. The damper film 30 is three-dimensionally hot formed by a matched molding method and is made of single-layered flexible thin film resin. Large ink damper chambers 40 and small ink damper chambers 41 as parts of the ink flow channels are formed between the lower surface of the flow channel forming member 22 and the damper film 30 to lesson a change in pressure of ink.

Figure 6:
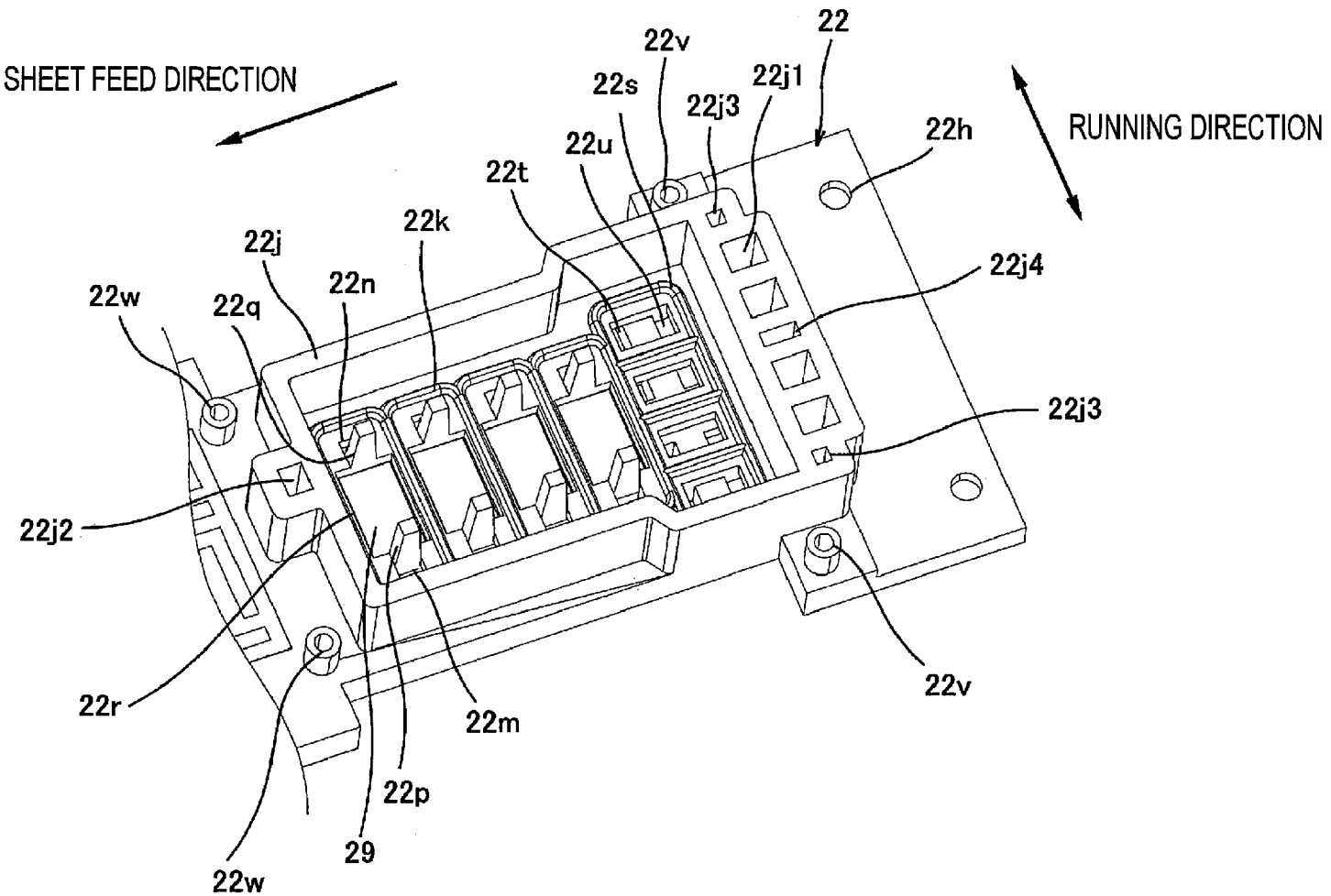
FIG. 6 is an enlarge perspective view of parts of the flow channel forming member shown in FIG. 5 when viewed from the below.

FIG. 6 is an enlarged perspective view of parts of the flow channel forming member 22 shown in FIG. 5 when viewed from the below. As shown in FIG. 6, large peripheral uplifted portions 22*k* are provided inside the peripheral rib 22*j* in the lower surface of the flow channel forming member 22, and the damper film 30 is welded to the large peripheral uplifted portions 22*k*. The large peripheral uplifted portions 22*k* are arranged in a longitudinal direction (sheet feed direction) of the flow channel forming member 22 so as to partition the large ink damper chamber 40 (see FIG. 5), which substantially has a rectangular shape in plan view, for each of four kinds of ink. Small peripheral uplifted portions 22*s* are provided adjacent to the large peripheral uplifted portions 22*k*. The small peripheral uplifted portions 22*s* are arranged in a widthwise direction (the running direction) of the flow channel forming member 22 so as to partition the small ink damper chamber 41 (see FIG. 5), which substantially has a rectangular shape in plan view, for each of four kinds of ink.

Inside each of the large peripheral uplifted portions 22*k* of the lower surface of the flow channel forming member 22, an inlet port 22*m* and an outlet port 22*n* are formed on both sides in the long-side direction (running direction). The inlet port 22*m* and the outlet port 22*n* are holes that communicate with the carriage-side ink flow channel 42 in the upper surface of the flow channel forming member 22. Protrusions 22*p* and 22*q* are provided between the inlet port 22*m* and the outlet port 22*n* to protrude toward the large ink damper chamber 40 in each of large swollen portions 30*b* to 30*e* (described below) of the damper film 30. The protrusions 22*p* and 22*q* are provided so as not to be in contact with swollen portions 30*b* to 30*e* in a state where the large swollen portions 30*b* to 30*e* (described below) are at atmospheric pressure. A film attaching portion 22*r* to which air-liquid separation film 29 (semi-permeable film) is attached is recessed between the protrusion 22*p* and the protrusion 22*q* to substantially have a rectangular shape in plan view. The air-liquid separation film 29 transmits gas but does not transmit a liquid. The air-liquid separation film 29 attached to the film attaching portion 22*r* is opposed to an opening 30*x* of each of the large swollen portions 30*b* to 30*e* (described below). A hole 22*x* (see FIG. 9) is provided in the film attaching portion 22*r* to communicate with the air exhaust flow channel 44 in the upper surface of the flow channel forming member 22.

Inside each of the small peripheral uplifted portions 22*s* in the flow channel forming member 22, an inlet port 22*t* and an outlet port 22*u* are formed on both sides of the long-side direction (sheet feed direction). The inlet port 22*t* and the outlet port 22*u* are holes that communicate the carriage-side ink flow channel 42 in the upper surface of the flow channel forming member 22. In the peripheral rib 22*j* of the flow channel forming member 22, four ink channels 22*j*1 are formed in an up-down direction to communicate with the outlet ports 22*u* on the upper surface side of the flow channel forming member 22. The air-liquid separation film 27 is attached to the upper surface of the flow channel forming member 22 to cover positions corresponding to the ink channels 22*j*1 and the outlet ports 22*u*. The air-liquid separation film 27 transmits gas but does not transmit a liquid.

On a downstream side in the sheet feed direction of the peripheral rib 22*j* of the flow channel forming member 22, a cooling liquid channel 22*j*2 is formed in which the cooling liquid from the cooling liquid flow channel 43 flows downward. On a front side in the sheet feed direction of the peripheral rib 22*j* of the flow channel forming member 22, a pair of cooling liquid channels 22*j*3 are formed on both sides in the running direction, in which the cooling liquid from a cooling liquid damper chamber 49 flows upward. Near the cooling liquid channels 22*j*3 outside the peripheral rib 22*j* of the flow channel forming member 22, a pair of cooling liquid channel cylindrical portions 22*v* are formed in which the cooling liquid flows downward. On the downstream side in the sheet feed direction outside the peripheral rib 22*j* of the flow channel forming member 22, a pair of cooling liquid channel cylindrical portions 22*w* are formed in which the cooling liquid from an IC chip cooling channel 51. In the peripheral rib 22*j* of the flow channel forming member 22, a cooling liquid channel 22*j*4 through which the cooling liquid damper chamber 49 (described below) communicates with the air-liquid separation film 27 is formed in the up-down direction between the inside two ink channels 22*j*1.

Figure 7:
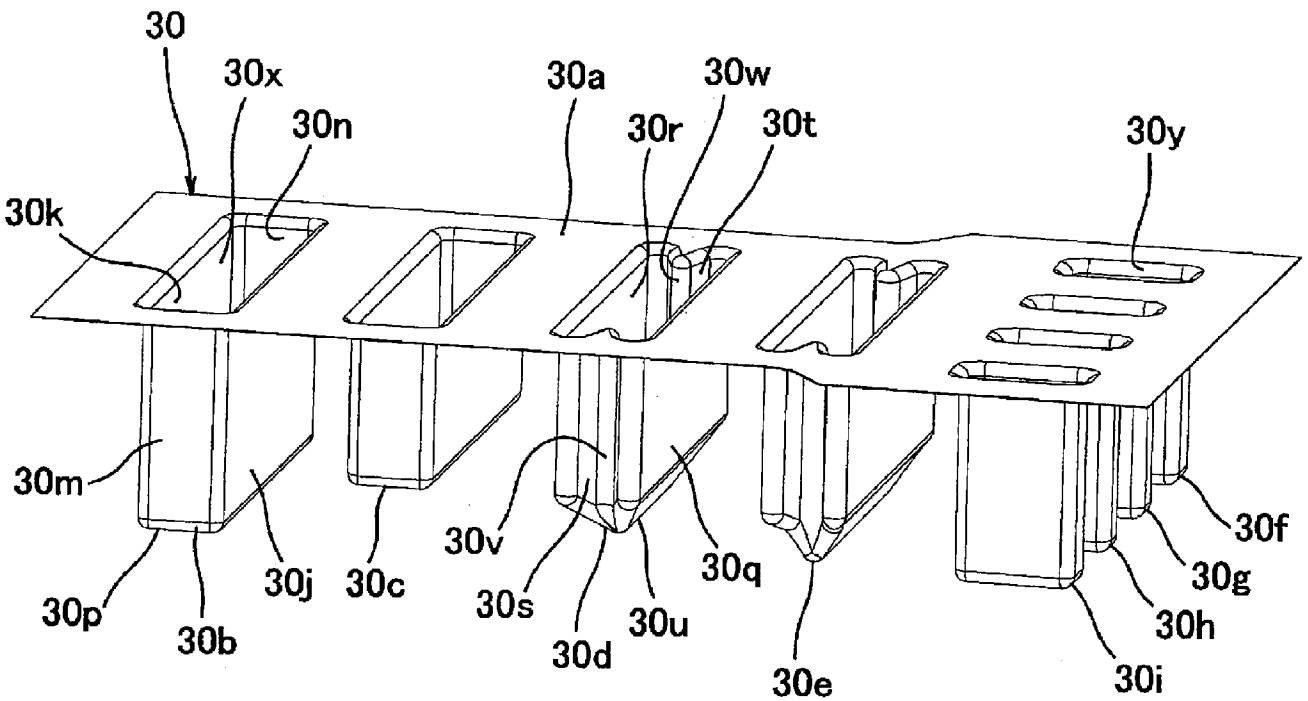
FIG. 7 is a perspective view of the damper film shown in FIG. 5 when viewed from the above.

FIG. 7 is a perspective view of the damper film 30 shown in FIG. 5 when viewed from the above. As shown in FIG. 7, the damper film 30 has a bonding surface 30*a*, openings 30*x* and 30*y*, and large swollen portions 30*b* to 30*e* and small swollen portions 30*f* to 30*i* (recording liquid flexible walls). The bonding surface 30*a* is bonded to the large peripheral up lifted portions 22*k* and the small peripheral uplifted portions 22*s* (see FIG. 6) of the flow channel forming member 22. The openings 30*x* and 30*y* are formed in the bonding surface 30*a* and have a rectangular shape to be slightly smaller than the large peripheral uplifted portions 22*k* and the small peripheral uplifted portions 22*s* (see FIG. 6). The large swollen portions 30*b* to 30*e* and the small swollen portions 30*f* to 30*i* are three-dimensionally swollen from the edges of the opening 30*x* and 30*y* in a gravity direction away from the flow channel forming member 22 (see FIG. 5). Therefore, by bonding the bonding surface 30*a* of the damper film 30 to the flow channel forming member 22 to close the openings 30*x* and 30*y*, the inner spaces of the four large swollen portions 30*b* to 30*e* form the large ink damper chambers 40 as parts of four kinds of ink flow channels. Further, the inner spaces of the four small swollen portions 30*f* to 30*i* form the small ink damper chambers 41 as parts of four kinds of ink flow channels. That is, as for one kind of ink, the large ink damper chamber 40 is disposed on the upstream side and the small ink damper chamber 41 is disposed on the downstream side. That is, a plurality of ink damper chambers 40 and 41 are disposed in one carriage-side ink flow channel 42.

The large swollen portions 30*b* to 30*e* individually have a pair of main surfaces 30*j*, 30*k*, 30*q*, and 30*r* that protrude from the edge of the long side of the opening 30*x* in the gravity direction and are opposed to each other, a pair of sub surfaces 30*m*, 30*n*, 30*s*, and 30*t* that protrude from the edge of the short side of the opening 30*x* in the gravity direction and are opposed to each other, and sub surfaces 30*p* and 30*u* that connect the main surfaces 30*j*, 30*k*, 30*q*, and 30*r* and the sub surfaces 30*m*, 30*n*, 30*s*, and 30*t*. That is, by bending the main surfaces 30*j*, 30*k*, 30*q*, and 30*r* of a large area to cause a large change in volume of the spaces in the large swollen portions 30*b* to 30*e*, when viewed from the above in plan view, even though the areas of the large swollen portions 30*b* to 30*e* are small, a large pressure change absorption effect can be obtained.

The large swollen portion 30*b* and the large swollen portion 30*c* substantially have the same shape but different lengths in the gravity direction. In the sub surfaces 30*s* and 30*t* of the large swollen portion 30*d* and the large swollen portion 30*e*, dent portions 30*v* and 30*w* are provided, the sections of which perpendicular to the main surfaces 30*q* and 30*r* have a dent shape. The sub surfaces 30*u* of the large swollen portion 30*d* and the large swollen portion 30*e* are crest portions whose sections perpendicular to the main surfaces 30*q* and 30*r* are crest shapes. With a cornice effect of the dent- or crest-shaped sub surfaces 30*s*, 30*t*, and 30*u*, the main surfaces 30*q* and 30*r* can move in the normal direction. Therefore, even though the areas of the large swollen portions 30*d* and 30*e* in plan view are small, a larger pressure change absorption effect can be obtained. The small swollen portions 30*f* to 30*i* substantially have the same as the large swollen portions 30*b* and 30*c* but different in size, and thus detailed descriptions thereof will be omitted. Moreover, the dent portions or the crest portions may be provided in the sub surfaces of all of the large swollen portions 30*b* to 30*e*, or may not be provided.

Returning to FIG. 4, the elastic seal member 31 is made of an elastic material, such as rubber, and has a flat plate portion 31*a* substantially having a rectangular shape in plan view. In the central portion of an upper surface of the flat plate portion 31*a*, a concave portion 31*b* is formed to correspond to the large swollen portions 30*b* to 30*e* and the small swollen portions 30*f* to 30*i* of the damper film 30. The concave portion 31*b* has a rectangular shape in plan view and is thinned. In the end surfaces on both sides of the flat plate portion 31*a* in the running direction, press portions 31*h* are individually provided to protrude toward IC chips 37 (described below).

On the upstream side of the flat plate portion 31*a* in the sheet feed direction (longitudinal direction), four ink holes 31*c* are formed to communicate liquid-tight with the four ink channels 22*j*1 (see FIG. 6) of the flow channel forming member 22. On the downstream side of the flat plate portion 31*a* in the sheet feed direction, a cooling liquid hole 31*d* is formed to communicate liquid-tight with the cooling liquid channel 22*j*2 (see FIG. 6) of the flow channel forming member 22. On both sides of the ink hole 31*c* of the flat plate portion 31*a* in the running direction, a pair of cooling holes 31*e* are formed to communicate light-tight with the pair of cooling liquid channels 22*j*3 (see FIG. 6) of the flow channel forming member 22. A cooling hole 31*f* is formed between the inside two ink holes 31*c* from among the four ink holes 31*c* of the flat plate portion 31*a* to communicate light-tight with the cooling liquid channel 22*j*4 (see FIG. 6) of the flow channel forming member 22.

Above both sides of the flat plate portion 31*a* in the running direction, a pair of rod portions 31*j* and 31*k* which are connected to the flat plate portion 31*a* as a single body extend along the longitudinal direction of the flat plate portion 31*a*. In the lower surfaces of the rod portions 31*j* and 31*k*, strip protrusions 31*m* and 31*n* are formed. The strip protrusions 31*m* and 31*n* are pressed into and seal grooves 31*f* (described below) of the carriage 32, in which the cooling liquid flows, from the above. On the upstream sides of the rod portions 31*j* and 31*k* in the sheet feed direction, a pair of cooling liquid channel cylindrical portions 31*p* are formed to communicate liquid-tight with the pair of cooling liquid channel cylindrical portions 22*v* (see FIG. 6) of the flow channel forming member 22, respectively. On the downstream sides of the rod portions 31*j* and 31*k* in the sheet feed direction, a pair of cooling liquid channel cylindrical portions 31*q* are formed to communicate liquid-tight with the pair of cooling liquid channel cylindrical portions 22*w* (see FIG. 6) of the flow channel forming member 22, respectively. As described above, the elastic seal member 31 serves as a part of the wall forming ink flow channel 60 (see FIG. 13) and a part of the wall forming the cooling liquid flow channel 61 (see FIG. 14), and seals both the ink flow channel 60 and the cooling liquid flow channel 61.

The carriage 32 is made of resin, and has a concave portion 32*a*, and rail guide portions 32*b* that protrude in a flange shape from upper ends on both sides of the concave portion 32*a* in the sheet feed direction (longitudinal direction) and are guided to the guide rails 2 and 3 (see FIG. 1). The rail guide portions 32*b* are provided with screw holes 32*h* to which the screws 26 are fastened. The concave portion 32*a* is provided with an ink hole 32*g*, which communicates liquid-tight with the ink holes 31*c* of the elastic seal member 31, on the upstream side of a bottom wall portion 32*c* thereof in the sheet feed direction (longitudinal direction). Both sides of the concave portion 32*a* in the running direction have a double walled structure having an outer wall portion 32*d* and an inner wall portion 32*e*. A groove 32*f* is formed between the outer wall portion 32*d* and the inner wall portion 32*e* to form the IC chip cooling channel 51. Heat sinks 45 and 46 made of a metal, such as aluminum, are embedded in the inner wall portion 32*e* and the rail guide portions 32*b* by insert molding, respectively. At the bottom wall portion 32*c* inside the inner wall portion 32*e*, a seal mounting portion 32*j* protrudes upward at a position corresponding to the peripheral rib 22*j* of the flow channel forming member 22. A slit 32*k* is provided at the bottom wall portion 32*c* between the seal mounting portion 32*j* and the inner wall portion 32*e*, and extended portions 36*a* and 36*b* of a flexible flat wire member 36 are inserted into the slit 32*k* from downward to upward.

The ink jet head 33 is attached to the lower side of the bottom wall portion 32*c* of the carriage 32. The ink jet head 33 has a flow channel unit 34 that has a plurality of ink chambers for guiding ink from the four ink inlet ports 34*a* to a plurality of nozzles (not shown), and a piezoelectric actuator 35 that is laminated on the upper surface of the flow channel unit 34 and selectively gives ejection pressure to ink in the flow channel unit 34 so as to be directed toward the nozzles. The ink inlet ports 34*a* of the flow channel unit 34 are covered with a filter 38. The ink inlet ports 34*a* communicate liquid-tight with the ink hole 32*g* of the carriage 32.

The flexible flat wire member 36 is bonded to the upper surface of the actuator 35. The flexible flat wire member 36 has a pair of extended portions 36*a* and 36*b* that extend from the upper surface of the actuator 35 toward both sides of the running direction. Actuator driving IC chips 37 are provided on the lower surfaces of the pair of extended portions 36*a* and 36*b* (on the outer surfaces when the pair of extended portions 36*a* and 36*b* turn upward). The IC chips 37 and actuator 35 serve as heat emitting elements that emit heat according to the discharging operation of the ink jet head 33.

Figure 8:
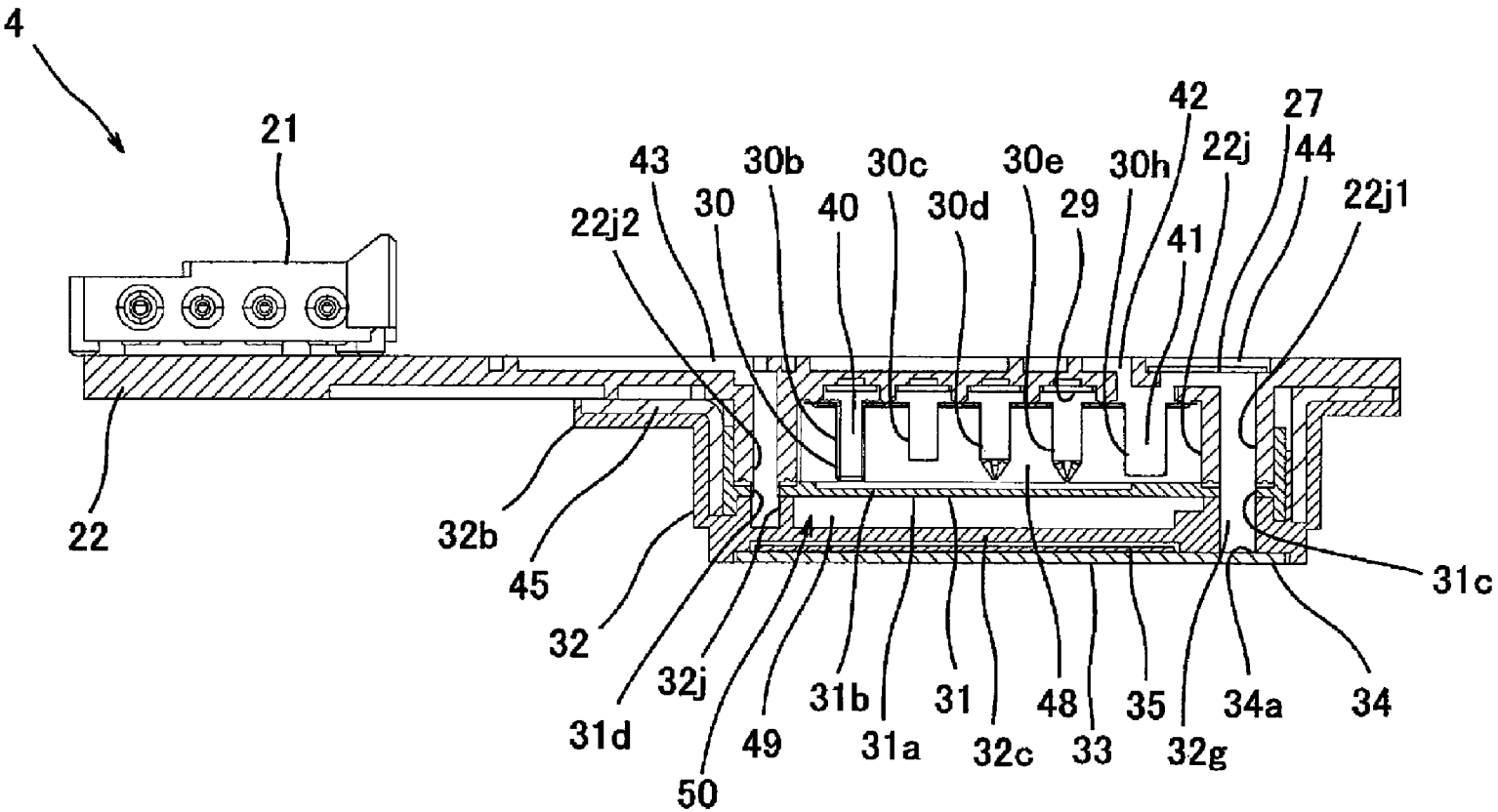
FIG. 8 is a sectional view taken along the line V-V of FIG. 2.
Figure 9:
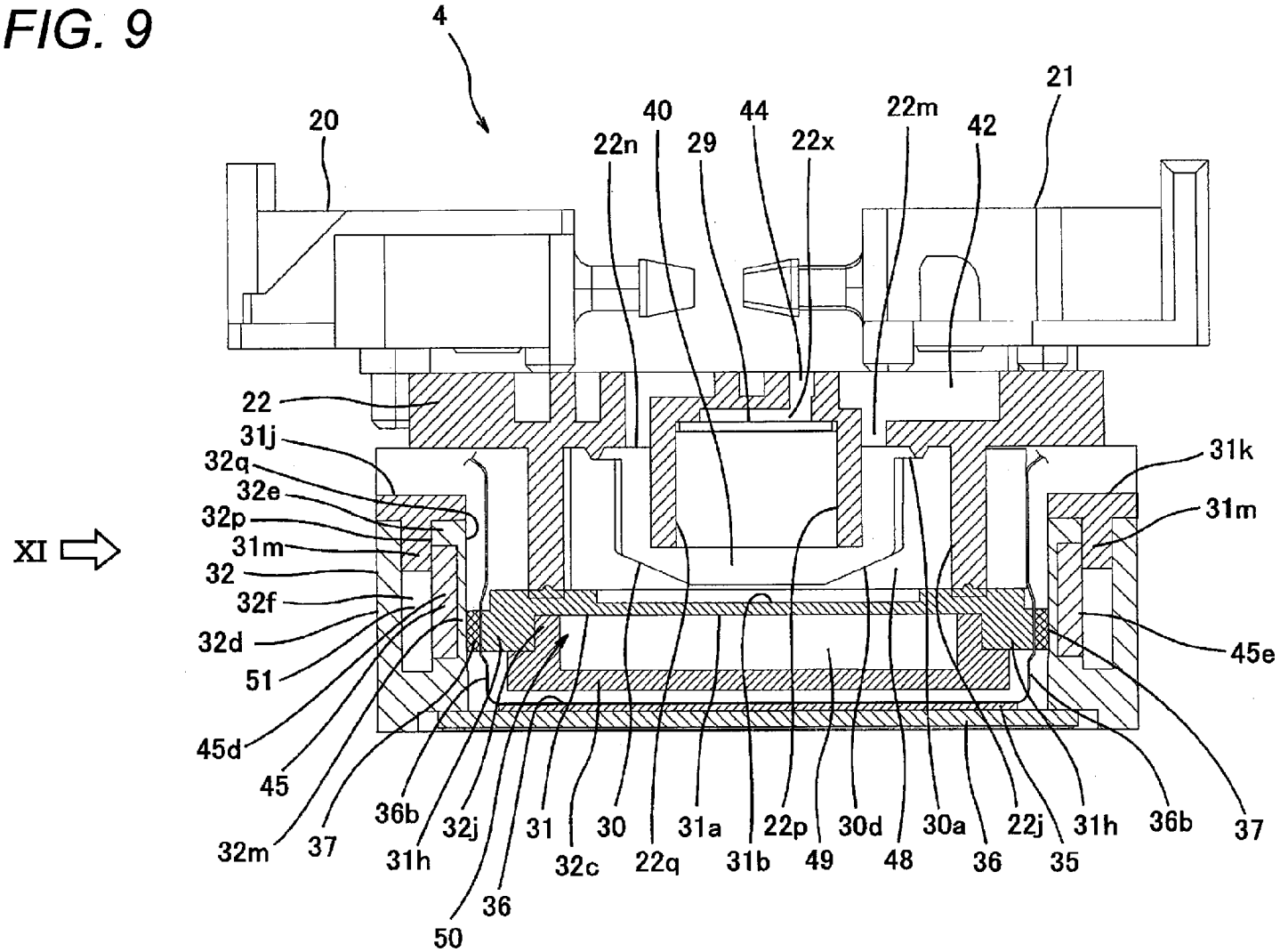
FIG. 9 is a sectional view taken along the line VI-VI of FIG. 2.

FIG. 8 is a sectional view taken along the line V-V of FIG. 2. FIG. 9 is a sectional view taken along the line VI-VI of FIG. 2. As shown in FIGS. 8 and 9, the flat plate portion 31*a* of the elastic seal member 31 is sandwiched between the peripheral rib 22*j* of the flow channel forming member 22 and the seal mounting portion 32*j* of the carriage 32. The cooling liquid damper chamber 49 is formed in a space defined by the lower surface of the elastic seal member 31, the upper surface of the bottom wall portion 32*c* of the carriage 32, and an inner peripheral surface of the seal mounting portion 32*j* of the carriage 32. The cooling liquid damper chamber 49 forms a part of the cooling liquid flow channel 43, and is provided at a position corresponding to the actuator 35 of the ink jet head 33. The cooling liquid damper chamber 49 and the actuator 35 are disposed to be close each other with the bottom wall portion 32*c* interposed therebetween. That is, the cooling liquid damper chamber 49 also functions as an actuator cooling flow channel for cooling the actuator 35. An air layer 48 is formed in a closed space defined by the upper surface of the flat plate portion 31*a* of the elastic seal member 31, the outer surface of the damper film 30, and an inner peripheral surface of the peripheral rib 22*j* of the flow channel forming member 22.

The ink damper chambers 40 and 41 and the cooling liquid damper chamber 49 are separated from each other by the swollen portions 30*h* to 30*i* of the damper film 30, the flat plate portion 31*a* of the elastic seal member 31, and the air layer 48. That is, the swollen portions 30*b* to 30*i*, the flat plate portion 31*a*, and the air layer 48 form a pressure transmission unit 50 that enables the ink damper chambers 40 and 41 and the cooling liquid damper chamber 49 to transmit pressure to each other.

As shown in FIG. 9, the protrusions 22*p* and 22*q* protrude in the large ink damper chamber 40 inside the swollen portion 30*d* of the damper film 30 so as not to be in contact with the swollen portion 30*d*. Ink flowing from the inlet port 22*m* into the large ink damper chamber 40 goes round the protrusion 22*p* and flows in the central portion of the large ink damper chamber 40. Air bubbles of ink in the central portion of the large ink damper chamber 40 are raised by a buoyant force and guided to the air exhaust flow channel 44 through the air-liquid separation film 29. Then, ink in the central portion of the large ink damper chamber 40 goes round the protrusion 22*q* and flows in the outlet port 22*n*.

The strip protrusions 31*m* and 31*n* in the rod portions 31*j* of the elastic seal member 31 are pressed into the groove 32*f* which is formed between the outer wall portion 32*d* and the inner wall portion 32*e* of the carriage 32, thereby forming the IC chip cooling channel 51. The IC chip cooling channel 51 communicates with the cooling liquid flow channel 43 and the cooling liquid damper chamber 49. The heat sink 45 is formed at the inner wall portion 32*e* so as to be exposed to the IC chip cooling channel 51 by insert molding and also functions as an inner wall portion. That is, the heat sink 45 is exposed to the IC chip cooling channel 51 so as to serve as a part of an inner surface 32*p* of the inner wall portion 32*e* (a surface partitioning the IC chip cooling channel 51), but it is not exposed to the outer surface 32*q* of the inner wall portion 32*e*.

The extended portions 36*a* and 36*b* of the flexible flat wire member 36 pass through upward between the inner wall portion 32*e* of the carriage 32 and the flat plate portion 31*a* of the elastic seal member 31. The IC chip 37 is pressed against the inner wall portion 32*e* by the press portion 31*h* of the elastic seal member 31. That is, the IC chip 37 comes into contact with an outer surface 32*q* of a thin covering portion 32*m* that is made of resin and covers the heat sink 45 of the inner wall portion 32*e* of the carriage 32. No heat sink is provided in the outer wall portion 32*d* partitioning the IC chip cooling channel 51, and the outer wall portion 32*d* of the IC chip cooling channel 51 passing around the IC chip 37 forms an outermost wall of the carriage 32.

Figure 10:
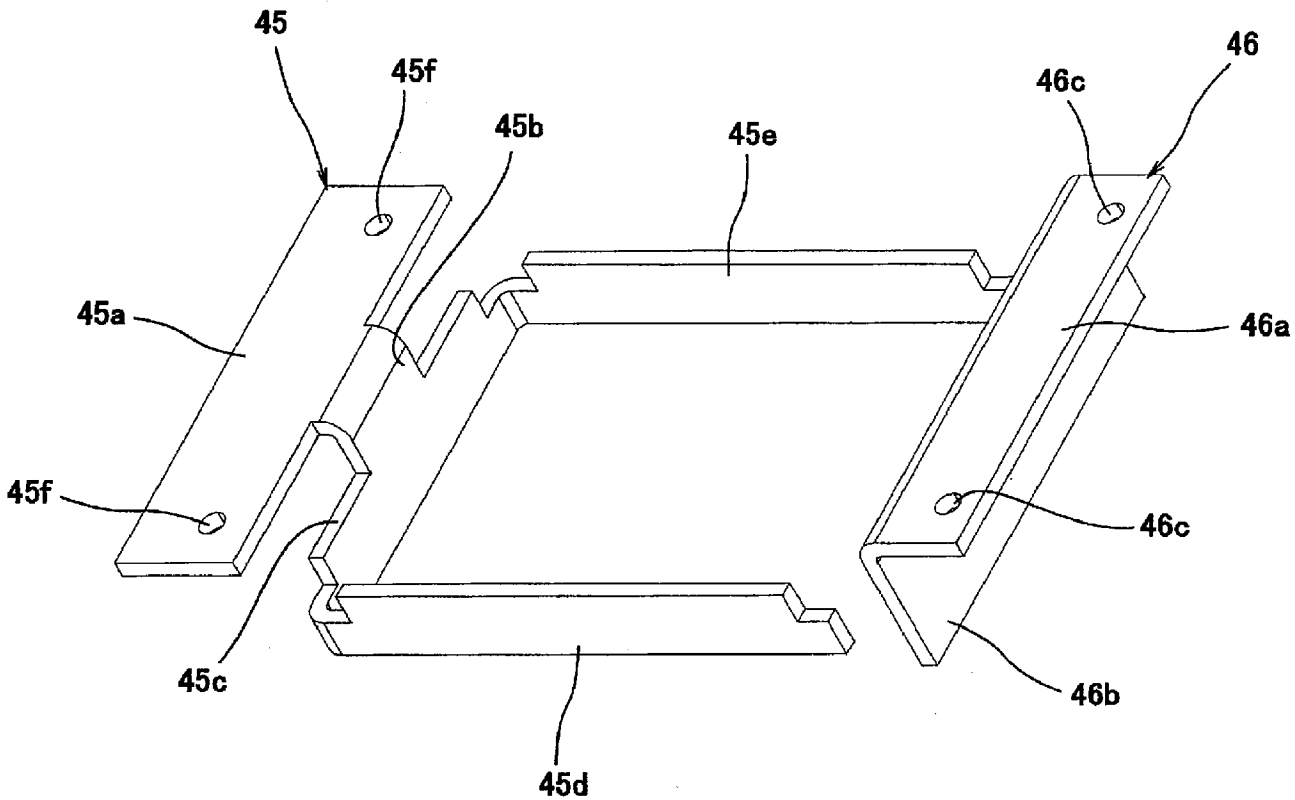
FIG. 10 is a perspective view of a heat sink of the head unit shown in FIG. 4.

FIG. 10 is a perspective view of the heat sink 45 and 46 in the head unit 4 shown in FIG. 4. As shown in FIG. 10, the heat sinks 45 and 46 are formed by pressing a metal plate. The heat sink 45 has a flanged portion 45*a* that has a rectangular shape in plan view and is embedded in one rail guide portion 32*b* of the carriage 32 (see FIG. 4), a vertical portion 45*b* that is bent downward from a central portion of an edge portion on a long side of the flanged portion 45*a*, a vertical wide portion 45*c* that is connected to a lower end of the vertical portion 45*b* and serves as a part of the wall of the carriage 32, and heat receiving portions 45*d* and 45*e* that individually extend from both ends of the vertical wide portion 45*c* along the inner wall portions 32*e* of the carriage 32 (see FIG. 4). That is, the heat receiving portions 45*d* and 45*e* of the heat sink 45 are individually embedded in the inner wall portions 32*e* of the carriage 32 (see FIG. 4) so as to be exposed to the IC chip cooling channel 51. The heat receiving portion 45*d* corresponding to one of the pair of IC chips 37 (see FIG. 4) and the heat receiving portion 45*e* corresponding to the other IC chip 37 are formed as a single body and serve as the heat sink 45.

Screw holes 45*f* are formed in the flanged portion 45*a* of the heat sink 45 to be aligned with the screw holes 32*h* of the carriage 32. That is, the screws 26 are inserted into and fastened to the screw holes 22*h* of the flow channel forming member 22, the screw holes 32*h* of the carriage 32, and the screw holes 45*f* of the heat sink 45. The heat sink 46 has a flanged portion 46*a* that has a rectangular shape in plan view and is embedded in the other rail guide portion 32*b* of the carriage 32 (see FIG. 4), and a vertical portion 46*b* that is bent downward from an edge portion on a long side of the flanged portion 46*a*. Screw holes 46*c* are formed in the flanged portion 46*a* to be aligned with the screw holes 32*h* of the carriage 32.

Figure 11:
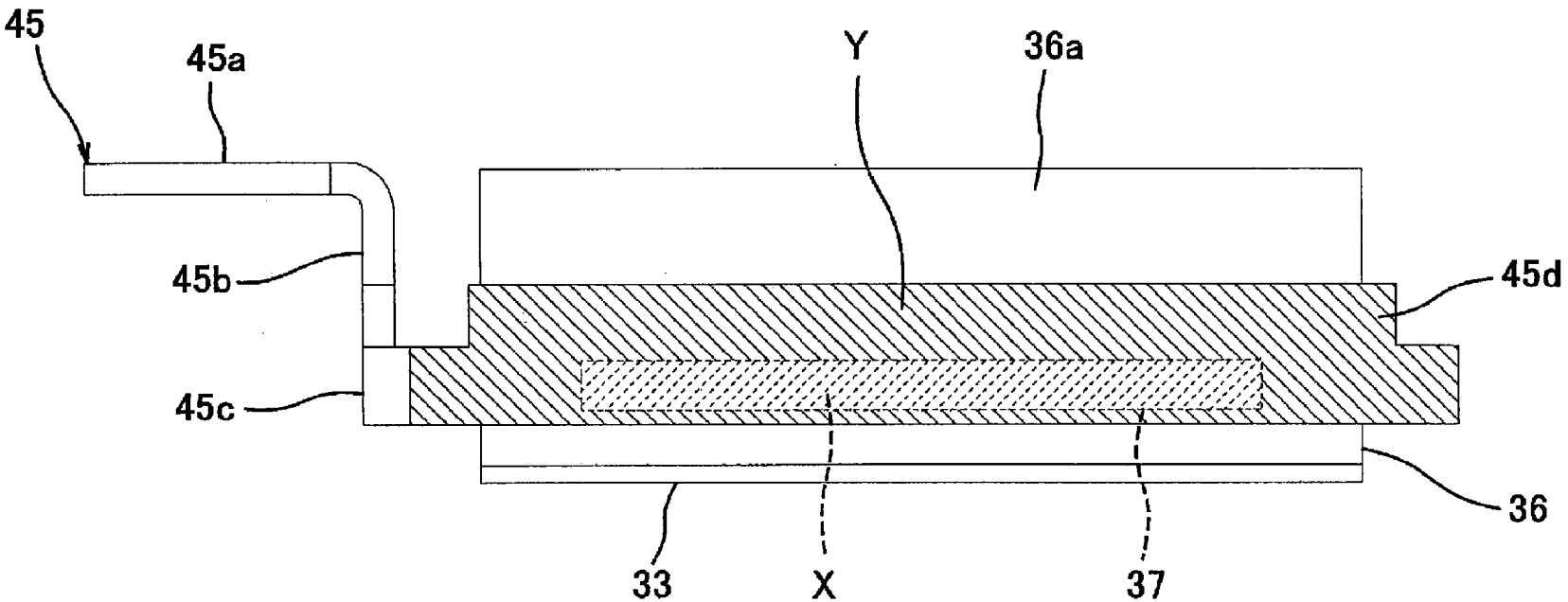
FIG. 11 is a diagram of a heat sink and an IC chip when viewed from an arrow XI direction of FIG. 9.

FIG. 11 is a diagram of the heat sink 45 and the IC chip 37 when viewed from an arrow XI direction. A hatched region indicated by symbol X of FIG. 11 is a projection region of the IC chip 37 on the inner surface 32*p* of the inner wall portion 32*e* (see FIG. 9) partitioning the IC chip cooling channel 51. A hatched region indicated by symbol Y in FIG. 11 is a projection region of the heat receiving portion 45*d* of the heat sink 45 on the inner surface 32*p* of the inner wall portion 32*e* (see FIG. 9) partitioning the IC chip cooling channel 51. A projection direction follows a line directly connecting the IC chip 37 and the inner surface 32*p* of the inner wall portion 32*e*, and a surface taking the line as the normal becomes a projection surface. As shown in FIG. 11, the projection region X of the IC chip 37 is included in the projection region Y of the heat receiving portion 45*d* of the heat sink 45. With this structure, heat emitted from the IC chip 37 is sufficiently transmitted to the heat receiving portion 45*d* of the heat sink 45.

Figure 12:
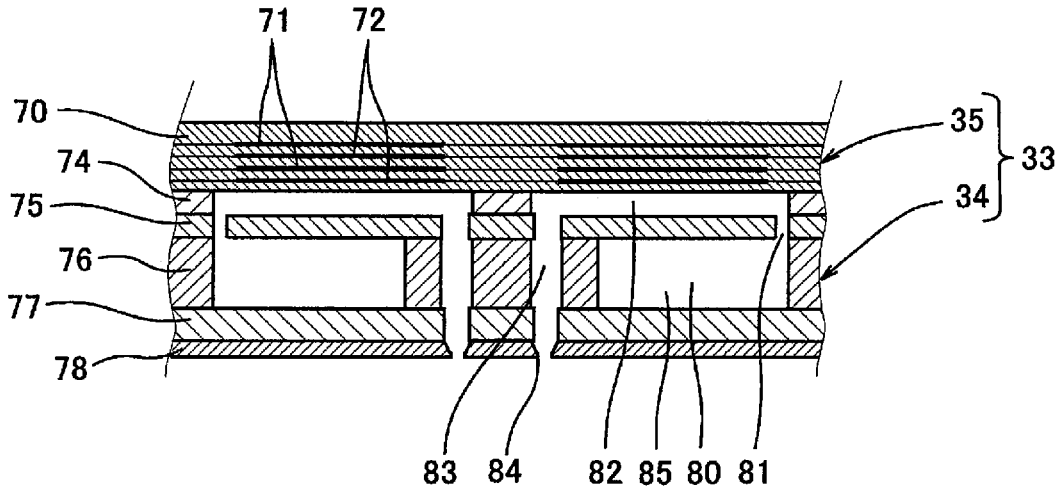
FIG. 12 is a sectional view showing parts of the ink jet head shown in FIG. 4.

FIG. 12 is a sectional view showing essential parts of the ink jet head 33 shown in FIG. 4. As shown in FIG. 12, in the ink jet head 33, as described above, the flow channel unit 34 and the actuator 35 are laminated and adhered to each other. The flow channel unit 34 is formed by laminating and bonding a plurality of plates 74 to 78 each having an opening to form the ink flow channel. In the lowermost plate 78, a plurality of nozzles 84 are formed downward and arranged in columns. In the uppermost plate 74, a plurality of pressure chambers 82 (liquid chamber) are formed and arranged in columns to correspond to the plurality of nozzles 84. An outflow channel 83 is provided in one end portion of each of the pressure chambers 82 to communicate with a corresponding nozzle 84, and a connection flow channel 81 is provided in the other end portion of the pressure chamber 82 to communicate with a corresponding common liquid chamber 80. The individual common liquid chambers 80 are continuously arranged in a column direction perpendicular to the scanning direction for the respective ink colors so as to overlap a plurality of pressure chambers 82 in plan view. Ink is supplied to the common liquid chambers 80 through the ink inlet ports 34*a* (see FIG. 4), which are formed in the upper surface of the flow channel unit 34.

The actuator 35 is formed by laminating a plurality of sheet-like piezoelectric bodies 70 made of PZT or the like, and is disposed to cover the pressure chambers 82. On the upper surface of each of even-numbered piezoelectric bodies 70 from the below of the piezoelectric bodies 70, individual electrodes 71 are provided at portions corresponding to the pressure chambers 82. On the upper surface of each of odd-numbered piezoelectric bodies 70 from the below, a common electrode 72 is continuously provided to correspond to a plurality of pressure chambers 82. That is, the individual electrodes 71 and the common electrodes 72 are arranged to be opposed to each other with one piezoelectric body 70, excluding the lowermost and uppermost piezoelectric bodies. Regions sandwiched between the individual electrodes 71 and the common electrodes 72 form driving parts. Then, if the IC chip 37 (see FIG. 4) applies a voltage to the individual electrodes 71 and the common electrodes 72 of the actuator 35 through the flexible flat wire member 36 (see FIG. 4), required portions of the piezoelectric bodies 70 are distorted in the lamination direction, and the volume of a required pressure chamber 82 is changed. Thus, ink is ejected from the nozzles 84.

Figure 13:
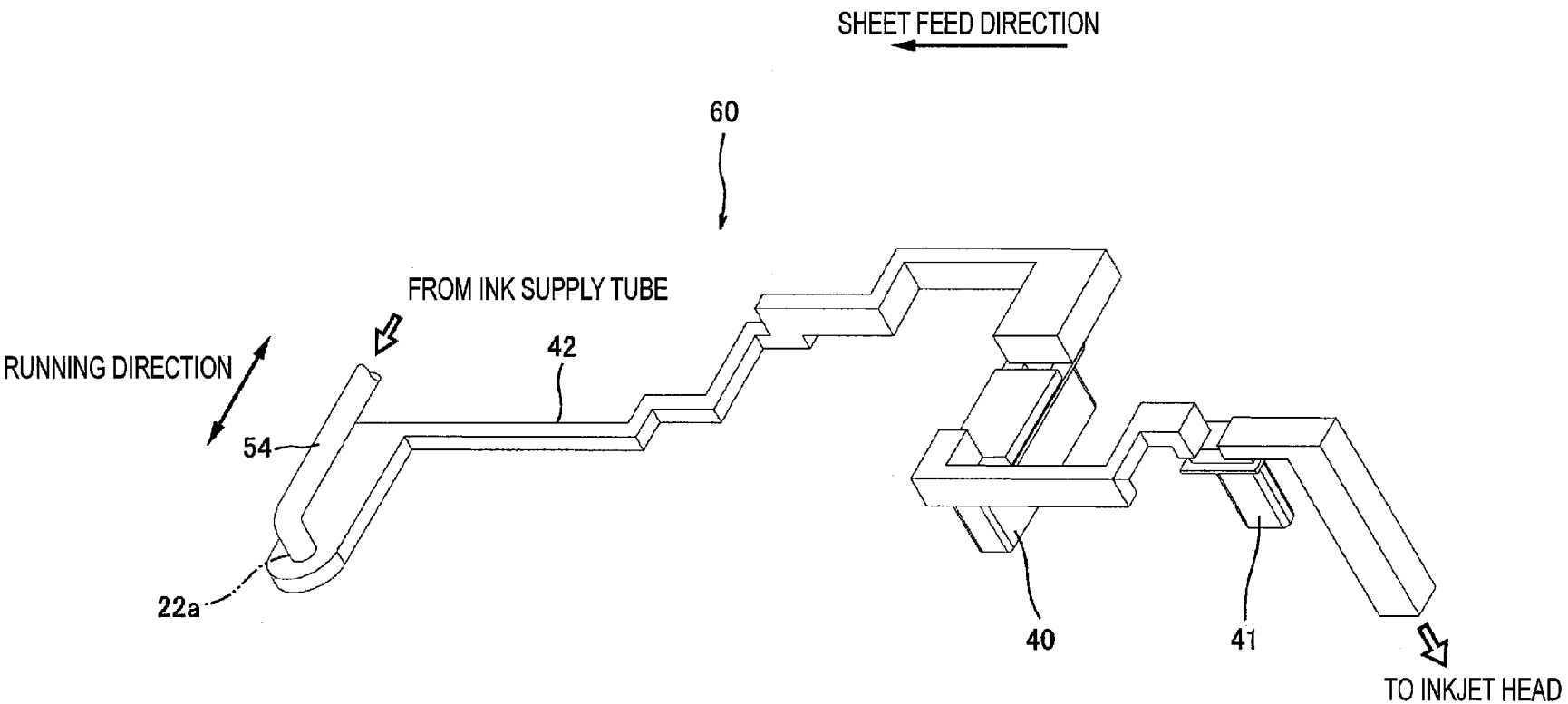
FIG. 13 is a perspective view showing one from among four ink flow channels in the head unit shown in FIG. 4.

FIG. 13 is a perspective view showing one from among the four carriage-side ink flow channels 42 in the head unit 4 shown in FIG. 4. As shown in FIGS. 2 and 13, the carriage-side ink flow channel 42 has a lead portion 54 that is led from the head unit 4 on one side of the running direction. The lead portion 54 is formed by an inner flow channel of the ink joint tube portions 20*b* of the joint 20 and an inner flow channel near the connection portions of the ink supply tubes 9 to the ink joint tube portions 20*b*. Moreover, an ink flow channel 60 (recording liquid flow channel) from the ink cartridge 8 to the ink jet head 33 is formed by a flow channel in the ink supply tubes 9 and the carriage-side ink flow channel 42.

Figure 14:
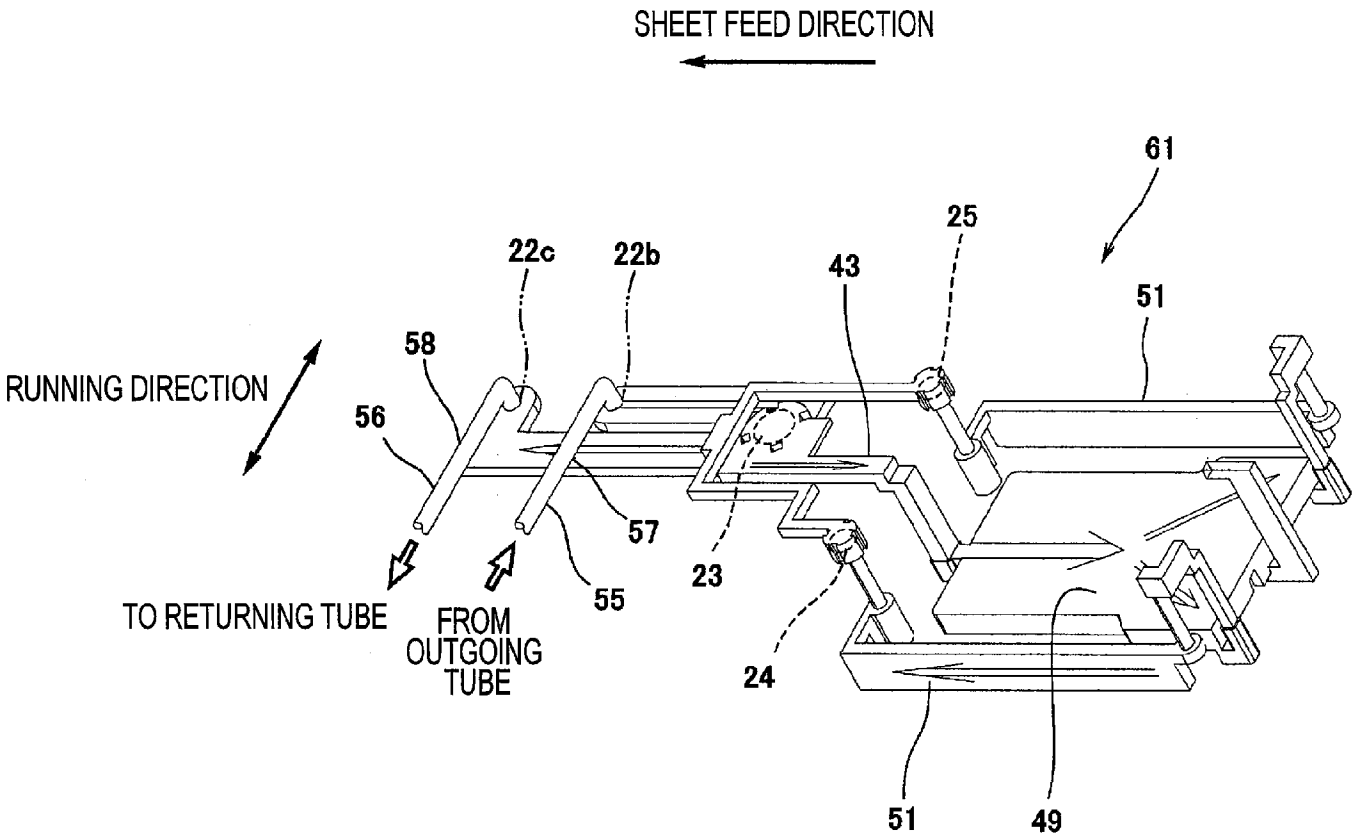
FIG. 14 is a perspective view of a cooling liquid flow channel in the head unit shown in FIG. 4.

FIG. 14 is a perspective view of the cooling liquid flow channel 43 in the head unit 4 shown in FIG. 4. As shown in FIGS. 2, 4, and 14, the cooling liquid flow channel 43, which is disposed on the carriage 32, communicates with a cooling liquid outgoing channel 55 connected to the cooling liquid inlet port 22*b* and a cooling liquid returning channel 56 connected to the cooling liquid outlet port 22*c*. The cooling liquid outgoing channel 55 is formed by an inner flow channel of the cooling liquid joint tube portion 21*b* of the joint 21, and an inner flow channel of the outgoing tube 10. The cooling liquid returning channel 56 is formed by an inner flow channel of the cooling liquid joint tube portion 21*c* of the joint 21 and an inner flow channel of the returning tube 11.

By determining the inner diameter of the cooling liquid returning channel 56 to be larger than the inner diameter of the cooling liquid outgoing channel 55, the cooling liquid returning channel 56 has flow channel resistance smaller than flow channel resistance of the cooling liquid outgoing channel 55. The inner diameters of the outgoing tube 10 and the returning tube 11 are larger than the inner diameter of each of the ink supply tubes 9, and the outgoing tube 10 and the returning tube 11 have hardness lower than hardness of the ink supply tubes 9.

The cooling liquid outgoing channel 55 and the cooling liquid returning channel 56 individually have lead portions 57 and 58 that are led from the head unit 4 toward the other side of the running direction. The lead portions 57 and 58 are individually formed by inner flow channels of the cooling liquid joint tube portions 21*b* and 21*c* of the joint 21, and inner flow channels near connection portions of the outgoing tube 10 and the returning tube 11 to the cooling liquid joint tube portions 21*b* and 21*c*. The check valve 23 is provided on the upstream side of the cooling liquid damper chamber 49 and the downstream side of the lead portion 57, and the check valves 24 and 25 are provided on the downstream side of the cooling liquid damper chamber 49 and the upstream side of the lead portion 58. The cooling liquid flow channel 43 branches off in parallel to the IC chip cooling channels 51 corresponding to the pair of IC chips 37 (see FIG. 9) from the cooling liquid damper chamber 49. A cooling liquid circulation flow channel 61 is formed by a flow channel in the radiator tank 12, a flow channel in the outgoing tube 10, a flow channel in the joint 21, the cooling liquid flow channel 43, and a flow channel in the returning tube 11.

Figure 15:
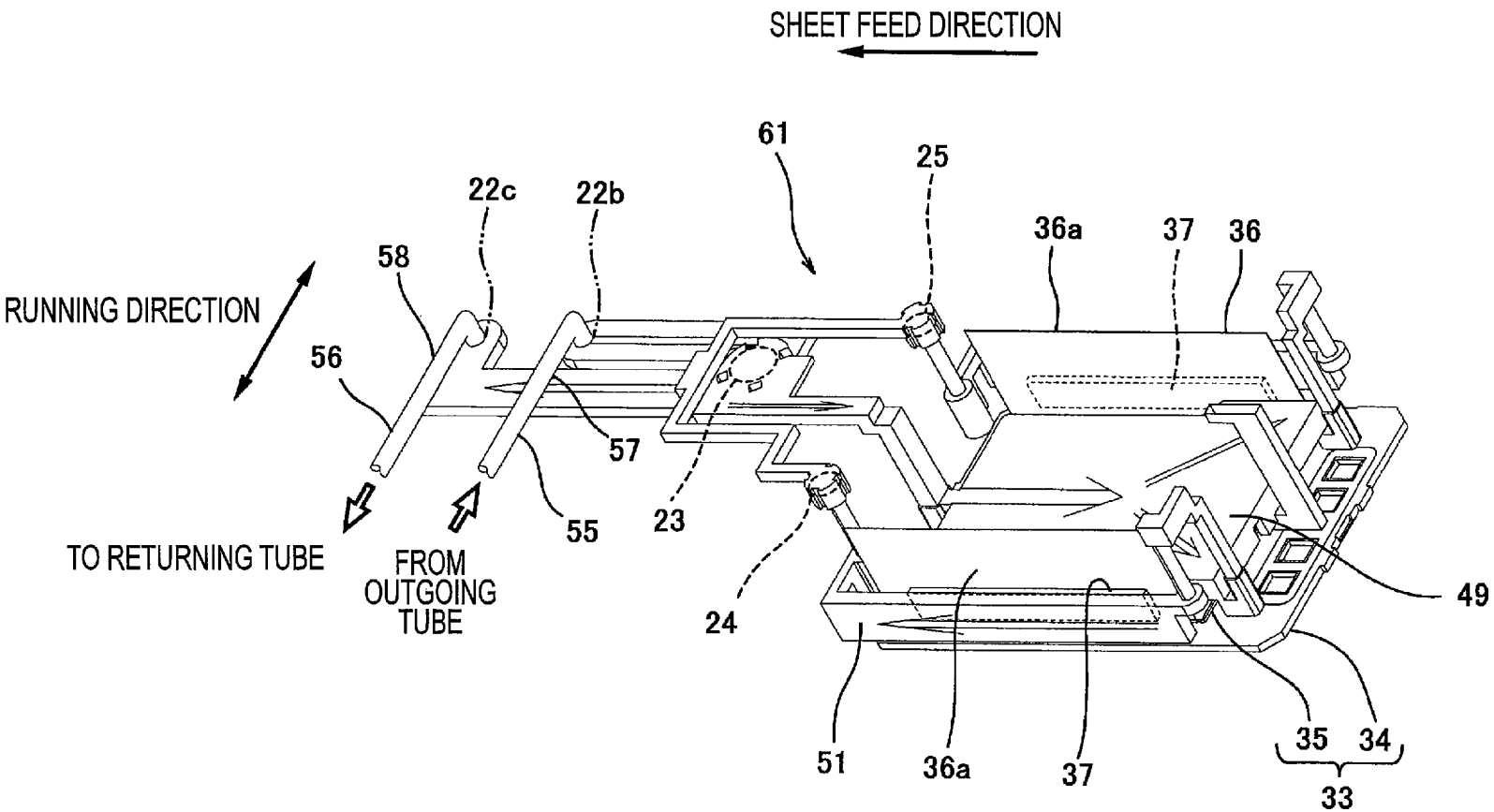
FIG. 15 is a perspective view illustrating the positional relationship of the cooling liquid flow channel, an IC chip, and an actuator shown in FIG. 14.

FIG. 15 is a perspective view illustrating the positional relationship of the cooling liquid flow channel 43, the IC chip 37, and the actuator 35 shown in FIG. 14. As shown in FIG. 15, the cooling liquid damper chamber 49 of the cooling liquid flow channel 43 is disposed in the vicinity of and above the actuator 35 of the inkjet head 33. Each of the parallel IC chip cooling channels 51 of the cooling liquid flow channel 43 is disposed in the vicinity of and above the IC chips 37 that are disposed in the extended portions 36*a* of the flexible flat wire member 36, respectively. Therefore, the liquid flowing in the cooling liquid flow channel 43 passes through the vicinity of the IC chips 37 after passing through the vicinity of the actuator 35 of the inkjet head 33.

Figure 16:
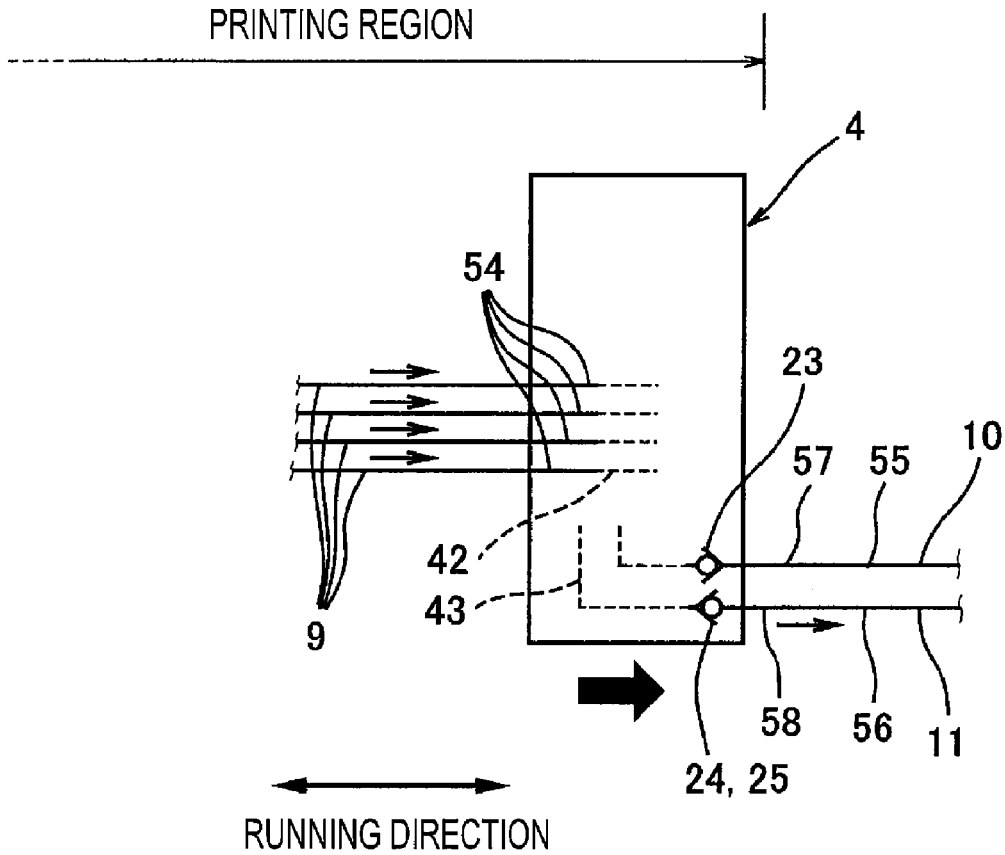
FIG. 16 is a schematic view showing a case where the head unit shown in FIG. 2 is turned at a right end.

FIG. 16 is a schematic view showing a case where the head unit 4 shown in FIG. 2 is turned at a right end (the other end). As shown in FIG. 16, when the head unit 4 is turned at the right end in the running direction, the head unit 4 is decelerated at a predetermined deceleration and is stopped at the right end, and then moves rightward while being accelerated at a predetermined acceleration. Therefore, positive pressure is applied to the carriage-side ink flow channel 42 due to an inertial force of ink in the lead portion 54 of the carriage-side ink flow channel 42. Meanwhile, negative pressure is applied to the cooling liquid flow channel 43 due to an inertial force of the cooling liquid in the lead portion 58 of the cooling liquid returning channel 56. That is, the cooling liquid from the cooling liquid flow channel 43 does not flow back to the cooling liquid outgoing channel 55 due to the check valve 23, but it passes through the check valves 24 and 25 and flows out to the cooling liquid returning channel 56. Therefore, negative pressure is generated in the cooling liquid flow channel 43. Then, if an inertial force in a right direction of the running direction applied to the cooling liquid in the lead portion 57 of the cooling liquid outgoing channel 55 is eliminated, the cooling liquid in the cooling liquid outgoing channel 55 passes through the check valve 23 and flows into the cooling liquid flow channel 43 due to the negative pressure of the cooling liquid flow channel 43.

Figure 17:
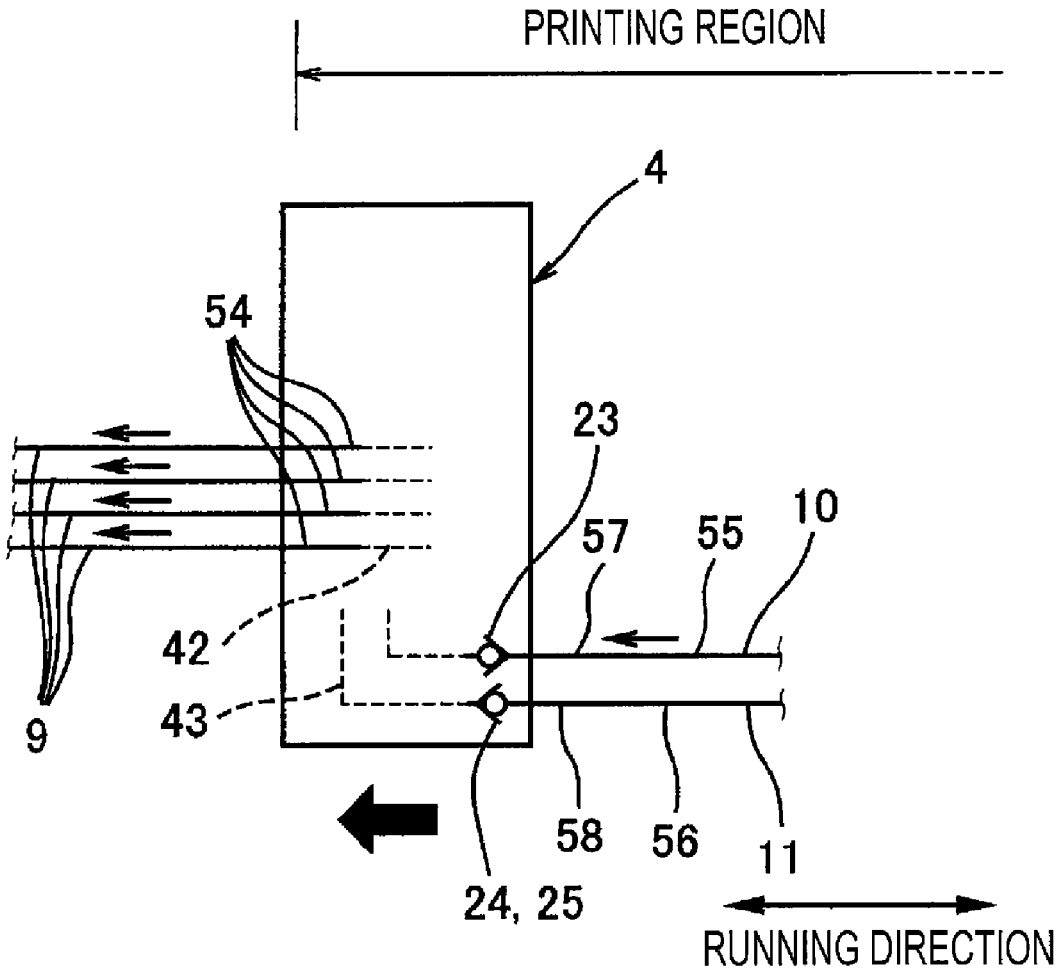
FIG. 17 is a schematic view showing a case where the head unit shown in FIG. 2 is turned at a left end.

FIG. 17 is a schematic view showing a case where the head unit 4 shown in FIG. 2 is turned at a left end. As shown in FIG. 17, when the head unit 4 is turned at the right end in the running direction, negative pressure is applied to the carriage-side ink flow channel 42 due to the inertial force of ink in the lead portion 54 of the carriage-side ink flow channel 42. Meanwhile, positive pressure is applied to the cooling liquid flow channel 43 due to the inertial force of the cooling liquid in the lead portion 57 of the cooling liquid outgoing channel 55. That is, the cooling liquid from the cooling liquid outgoing channel 55 passes through the check valve 23 and flows into the cooling liquid flow channel 43, while the cooling liquid from the cooling liquid flow channel 43 does not flow out to the cooling liquid returning channel 56 due to the check valves 24 and 25. Therefore, positive pressure in the cooling liquid flow channel 43 is increased. Then, if an inertial force in a left direction of the running direction applied to the cooling liquid of the lead portion 58 of the cooling liquid returning channel 56 is eliminated, the cooling liquid in the cooling liquid flow channel 43 passes through the check valves 24 and 25 and flows out to the cooling liquid returning channel 56 due to the positive pressure in the cooling liquid flow channel. That is, the cooling liquid is circulated by using the inertial force applied to the cooling force due to the reciprocation of the head unit 4, without using an electric-powered pump.

According to the above-described configuration, since the heat sink 45 is in direct contact with the cooling liquid, heat received by the heat sink 45 from the IC chip 37 and the like is efficiently radiated to the cooling liquid. In addition, the heat sink 45 is provided such that the projection region X of the IC chip 37 on the inner surface 32*p* of the IC chip cooling channel 51 is included in the projection region Y of the heat sink 45 on the inner surface 32*p* of the IC chip cooling channel 51. Therefore, even though the IC chip 37 is small in size, heat can be sufficiently transmitted to the heat sink 45. As a result, even if the apparatus is reduced in size, heat dissipation efficiency can be improved. Furthermore, since the heat sink 45 is provided so as to serve as a part of the inner wall portion 32*e* partitioning the IC chip cooling channel 51, the apparatus can be made compact.

The heat sinks 45 and 46 are insert-molded in the carriage 32 in advance. Therefore, in assembling the apparatus, the heat sinks 45 and 46 do not need to be assembled with the carriage 32, and thus assembling workability is improved. In addition, since the metallic heat sinks 45 are 46 are insert-molded, the rigidity of the plastic carriage 32 is increased, and as a result the carriage 32 can be reduced in thickness and be compact.

The covering portion 32*m* of the plastic carriage 32 covering the heat sink 45 is interposed between the IC chip 37 and the metallic heat sink 45. Therefore, it is possible to prevent the IC chip 37 from being damaged. In addition, no heat sink is provided in the outer wall portion 32*d* of the IC chip cooling channel 51, and the outer wall portion 32*d* becomes the outermost wall of the carriage 32. As a result, heat is also radiated from the outer wall portion to the air, and thus it is possible to prevent heat from staying inside the carriage 32.

The IC chip 37 is pressed toward the heat receiving portions 45*d* and 45*e* of the heat sink 45 by the elastic seal member 31. Therefore, heat from the IC chip 37 can be stably transmitted to the heat sink 45. In addition, since the elastic seal member 31 serves as a member for pressing the IC chip 37, it is possible to suppress an increase in the number of parts and the number of steps when assembling. Furthermore, since the elastic seal member 31 both serves as the wall forming the ink flow channel 60 and the wall forming the cooling liquid flow channel 61, it is possible to suppress an increase in the number of parts and the number of steps when assembling.

The heat receiving portions 45*d* and 45*e* corresponding to a pair of IC chips 37 are formed as a single body and serve as the heat sink 45. Therefore, when the amounts of heat emission from the IC chips 37 are different, a portion of the heat sink 45 corresponding to one IC chip 37 having a smaller amount of heat emission contributes to heat dissipation of the other IC chip 37 having a larger amount of heat emission. As a result, the heat capacity of the heat sink 45 can be increased as a whole.

The cooling liquid flow channel 61 is disposed to pass around the IC chip 37 after passing around the actuator 35. Therefore, it is possible to prevent the cooling liquid from transferring heat received from the IC chip 37 to the ink jet head 33. Therefore, stable ejection performance can be maintained. In addition, the cooling liquid flow channel 61 branches off in parallel to correspond to the IC chips 37, and thus it is possible to uniformly cool the IC chips 37.

Although in the exemplary embodiment the invention is applied to the ink jet printer, the invention may be applied to a liquid discharging apparatus that discharges a liquid other than ink, for example, an apparatus that discharges a coloring liquid to manufacture color filters for a liquid crystal display, or an apparatus that ejects a conductive liquid to form electric wires. Further, although in the exemplary embodiment the present invention is applied to the ink jet printer that has the ink jet head 4 as shown in FIG. 1, the present invention may be applied to a liquid discharging apparatus that has a line type inkjet head.

As described above, the liquid discharging apparatus according to the invention has an excellent effect in improving heat dissipation efficiency even if the apparatus is reduced in size. Advantageously, the invention can be widely applied to an inkjet printer that is capable of exerting the significance of this effect.

According to an aspect of the invention, a liquid discharging apparatus includes: a liquid discharging head that is provided on a carriage being scanned with respect to a recording medium, a recording liquid from a recording liquid supply source being supplied to the liquid discharging head through a recording liquid flow channel on the carriage; a heat emitting element that emits heat according to an discharging operation of the liquid discharging head; a cooling liquid flow channel that is provided on the carriage and passes around the heat emitting element; and a heat sink that is provided between the heat emitting element and the cooling liquid flow channel, at least a part of the heat sink being exposed to the cooling liquid flow channel so as to serve as a part of an inner surface of a wall partitioning the cooling liquid flow channel. A projection region of the heat emitting element on the inner surface is included in a projection region of the heat sink on the inner surface.

With this configuration, since the heat sink is indirect contact with the cooling liquid, heat received by the heat sink from the heat emitting element is efficiently radiated to the cooling liquid. In addition, the heat sink is provided such that the projection region of the heat emitting element on the inner surface of the cooling liquid flow channel is included in the projection region of the heat sink on the inner surface of the cooling liquid flow channel. Therefore, even though the heat emitting element is small in size, heat can be sufficiently transmitted to the heat sink. As a result, even if the apparatus is reduced in size, heat dissipation efficiency can be improved. Furthermore, since the heat sink is provided so as to serve as a part of the wall partitioning the cooling liquid flow channel, the apparatus can be made compact.

The carriage may be made of resin, and the heat sink may be made of a metal. The heat sink may be insert-molded in the carriage.

With this configuration, the heat sink is insert-molded in the carriage in advance. Therefore, in assembling the apparatus, the heat sink does not need to be assembled with the carriage, and thus assembling workability is improved. In addition, since the metallic heat sink is insert-molded, the rigidity of the plastic carriage is increased, and as a result the carriage can be reduced in thickness and be compact.

The heat sink may be exposed toward the inner surface without being exposed toward an outer surface of the wall partitioning the cooling liquid flow channel, and the heat emitting element may be in contact with the outer surface of the wall partitioning the cooling liquid flow channel.

With this configuration, resin as a part of the carriage covering the heat sink is interposed between the heat emitting element and the metallic heat sink. Therefore, it is possible to prevent the heat emitting element from being damaged.

The heat sink may be provided in an inner wall portion inside of the carriage in the wall partitioning the cooling liquid flow channel without being provided in an outer wall portion outside of the carriage. The outer wall portion may form an outermost wall of the carriage at a position of the cooling liquid flow channel corresponding to the heat emitting element.

With this configuration, the outer wall portion that partitions a flow channel of the cooling liquid which receives heat from the heat emitting element through the heat sink forms the outermost wall of the carriage. Therefore, heat is also radiated from the outer wall portion to the air, and thus it is possible to prevent heat from staying inside the carriage.

The liquid discharging apparatus may further include an elastic seal member that seals the recording liquid flow channel and/or the cooling liquid flow channel. The heat emitting element may be pressed toward the head sink by the elastic seal member.

With this configuration, since the heat emitting element is pressed toward the heat sink by the elastic seal member, heat from the heat emitting element can be stably transmitted to the heat sink. In addition, since the elastic seal member serves as a member for pressing the heat emitting element, it is possible to suppress an increase in the number of parts and the number of steps when assembling.

The liquid discharging apparatus may further include an elastic seal member that seals the recording liquid flow channel and the cooling liquid flow channel. The elastic seal member may serve as a part of a wall forming the recording liquid flow channel and a part of a wall forming the cooling liquid flow channel.

With this configuration, the elastic seal member serves as a part of the wall forming the recording liquid flow channel and a part of the wall forming the cooling liquid flow channel. Therefore, it is possible to suppress an increase in the number of parts and the number of steps when assembling.

The liquid discharging apparatus may further include a flow channel forming member that is provided on the carriage. The heat sink may have a screw hole into which the flow channel forming member is threaded.

With this configuration, by threading the flow channel forming member into the screw hole of the metallic heat sink, the carriage can be stably fixed with respect to the flow channel forming member, without using an additional metallic member.

The heat emitting element may be an IC chip for driving the liquid discharging head. A pair of IC chips may be provided at corresponding positions on both sides of the liquid discharging head, and the heat sink as a single body may be disposed to correspond to the IC chips.

With this configuration, the heat sink as a single body is disposed to correspond to a pair of IC chips. Therefore, when the amounts of heat emission from the two IC chips are different, a portion of the heat sink corresponding to one IC chip having a smaller amount of heat emission contributes to heat dissipation of the other IC chip having a larger amount of heat emission. As a result, the heat capacity of the heat sink can be increased as a whole.

The heat emitting element may be an IC chip for driving the liquid discharging head. The liquid discharging head may have a flow channel unit that has a plurality of liquid chambers provided to correspondingly communicate with the plurality of nozzles, and an actuator that has a plurality of driving parts for individually changing the plurality of liquid chambers.

The cooling liquid flow channel may be disposed so as to pass around the IC chip after passing around the actuator.

With this configuration, even if the cooling liquid cools both the actuator and the IC chip, it is possible to prevent the cooling liquid from transferring heat received from the IC chip to the liquid droplet ejection head. Therefore, stable ejection performance can be maintained.

A plurality of heat emitting elements may be provided, and the cooling liquid flow channel may branch off in parallel to correspond to the heat emitting elements.

With this configuration, it is possible to uniformly cool a plurality of heat emitting elements. That is, if cooling liquid flow channels for cooling a plurality of heat emitting elements are provided in series, as for a heat emitting element on a downstream side, a cooling effect is deteriorated. In contrast, if the cooling liquid flow channel branches off in parallel, it is possible to uniformly cool the heat emitting elements by a single cooling liquid flow channel.

As will be apparent from the above description, according to the invention, since the heat sink is in direct contact with the cooling liquid, heat received by the heat sink from the heat emitting element is efficiently radiated to the cooling liquid. In addition, the heat sink is provided such that the projection region of the heat emitting element on the inner surface of the cooling liquid flow channel is included in the projection region of the heat sink on the inner surface of the cooling liquid flow channel. Therefore, even though the heat emitting element is small in size, heat can be sufficiently transmitted to the heat sink. As a result, even if the apparatus is reduced in size, heat dissipation efficiency can be improved. Furthermore, since the heat sink is provided so as to serve as a part of the wall partitioning the cooling liquid flow channel, the apparatus can be made compact.

What is claimed is:

1. A liquid discharging apparatus comprising:

a liquid discharging head that is provided on a carriage being moved with respect to a recording medium, a recording liquid, which is supplied from a recording liquid supply source, being supplied to the liquid discharging head through a recording liquid flow channel on the carriage;

a heat emitting element that emits heat with a discharging operation of the liquid discharging head;

a cooling liquid flow channel that is provided in the carriage and passes around the heat emitting element; and a heat sink that is provided between the heat emitting element and the cooling liquid flow channel, at least a part of the heat sink being exposed to the cooling liquid flow channel so as to serve as a part of an inner surface of a wall partitioning the cooling liquid flow channel.

2. The liquid discharging apparatus according to claim 1, wherein a projection region of the heat emitting element on the inner surface of the wall is included in a projection region of the heat sink on the inner surface of the wall.

3. The liquid discharging apparatus according to claim 1, wherein the carriage is made of resin, and the heat sink is made of a metal, and the heat sink is insert-molded in the carriage.

4. The liquid discharging apparatus according to claim 3, wherein the heat sink is exposed toward the inner surface of the wall without being exposed toward an outer surface of the wall partitioning the cooling liquid flow channel, and the heat emitting element is in contact with the outer surface of the wall partitioning the cooling liquid flow channel.

5. The liquid discharging apparatus according to claim 1, wherein the heat sink is provided in an inner wall portion inside of the carriage in the wall partitioning the cooling liquid flow channel without being provided in an outer wall portion outside of the carriage, and the outer wall portion forms an outermost wall of the carriage at a position of the cooling liquid flow channel corresponding to the heat emitting element.

6. The liquid discharging apparatus according to claim 1, further comprising:

an elastic seal member that seals the recording liquid flow channel and/or the cooling liquid flow channel, wherein the heat emitting element is pressed toward the heat sink by the elastic seal member.

7. The liquid discharging apparatus according to claim 1, further comprising:

an elastic seal member that seals the recording liquid flow channel and the cooling liquid flow channel, wherein the elastic seal member serves as a part of a wall forming the recording liquid flow channel and a part of a wall forming the cooling liquid flow channel.

8. The liquid discharging apparatus according to claim 1, further comprising:

a flow channel forming member that is provided on the carriage, wherein the heat sink has a screw hole into which the flow channel forming member is threaded.

9. The liquid discharging apparatus according to claim 1, where in the heat emitting element is an IC chip for driving the liquid discharging head, and a pair of IC chips are provided at corresponding positions on both sides of the liquid discharging head, and the heat sink as a single body is disposed to correspond to the IC chips.

10. The liquid discharging apparatus according to claim 1, wherein the heat emitting element is an IC chip for driving the liquid discharging head, the liquid discharging head has a flow channel unit that has a plurality of liquid chambers provided to correspondingly communicate with the plurality of nozzles, and an actuator that has a plurality of driving parts for individually changing the plurality of liquid chambers, and the cooling liquid flow channel is disposed so as to pass around the IC chip after passing around the actuator.

11. The liquid discharging apparatus according to claim 1, wherein a plurality of heat emitting elements are provided, and the cooling liquid flow channel branches off in parallel to correspond to the heat emitting elements.

12. The liquid discharging apparatus according to claim 1, wherein the cooling liquid flow channel includes a cooling liquid damper chamber and a IC chip cooling channel that is branched off from the cooling liquid damper chamber, and wherein the heat sink is disposed between the cooling liquid damper chamber and the IC chip cooling channel when viewed from a plan view.

* * * * *